US007735686B2

(12) United States Patent
Ophardt

(10) Patent No.: US 7,735,686 B2
(45) Date of Patent: Jun. 15, 2010

(54) VACUUM SWITCH MULTI RESERVOIR DISPENSER

(75) Inventor: Heiner Ophardt, Vineland (CA)

(73) Assignee: Gotohti.com Inc., Beamsville, Ontario (CA)

( * ) Notice: Subject to any disclaimer, the term of this patent is extended or adjusted under 35 U.S.C. 154(b) by 782 days.

(21) Appl. No.: 11/636,945

(22) Filed: Dec. 12, 2006

(65) Prior Publication Data

US 2008/0135578 A1 Jun. 12, 2008

(30) Foreign Application Priority Data

Nov. 9, 2006 (CA) ..... 2567671

(51) Int. Cl.
*B67D 7/70* (2010.01)

(52) U.S. Cl. ..... 222/136; 222/94

(58) Field of Classification Search ..... 222/136, 222/130, 131, 100.105, 106, 160, 166, 180, 222/181.1–181.3, 182, 94, 132, 129, 142, 222/628, 321.7–321.9, 145.1, 144.5
See application file for complete search history.

(56) References Cited

U.S. PATENT DOCUMENTS 4,474,307 A * 10/1984 Chappell ..... 222/1
4,561,571 A * 12/1985 Chen ..... 222/207
4,895,276 A * 1/1990 Maldonado ..... 222/144.5
5,042,693 A * 8/1991 De Luca ..... 222/145.1
5,165,577 A 11/1992 Ophardt
5,169,029 A * 12/1992 Behar et al. ..... 222/1
5,431,309 A 7/1995 Ophardt
5,556,005 A * 9/1996 Banks ..... 222/96
5,944,227 A * 8/1999 Schroeder et al. ..... 222/144.5
5,975,360 A 11/1999 Ophardt
6,957,751 B2 10/2005 Ophardt
2005/0161476 A1 7/2005 Ophardt
2005/0263545 A1 12/2005 Ophardt
2006/0032871 A1 2/2006 Ophardt
2006/0175354 A1 8/2006 Ophardt

* cited by examiner

*Primary Examiner*—Lien T Ngo
(74) *Attorney, Agent, or Firm*—Riches, McKenzie & Herbert LLP

(57) ABSTRACT

A vacuum controlled valve mechanism providing two separate one-way valves, one for each of a pair of collapsible fluid containing reservoirs with each valve being in an initial sealed condition preventing flow therethrough until by operation of the pump mechanism a threshold vacuum is exceeded and with the threshold vacuum of a first of the valves being greater than the threshold vacuum of the other, second of the valves. When the threshold vacuum of the first valve is exceeded, that first valve separately permits dispensing of fluid from its reservoir under vacuum conditions less than the threshold vacuum of the first valve and the second valve until the first reservoir is substantially empty after which further operation of the pump mechanism creates a vacuum which exceeds the threshold vacuum for the second valve after which the second valve permits dispensing of fluid from the second reservoir.

20 Claims, 26 Drawing Sheets

VACUUM SWITCH MULTI RESERVOIR DISPENSER

SCOPE OF THE INVENTION

This invention relates to a vacuum controlled switch valve mechanism and a dispenser for selective dispensing from at least two separate reservoirs.

BACKGROUND OF THE INVENTION

Dispensers of fluid materials are well known in which fluid is dispensed from a reservoir and after the reservoir is emptied of the fluid, the reservoir must be replaced or replenished with fluid.

Known hand soap dispensers for use in washrooms provide a washing fluid in a bottle-like reservoir with the entirety of the reservoir to be replaced with a new reservoir when additional fluid is required. Preferably, the reservoir is an enclosed reservoir which collapses on dispensing fluid so as to minimize risks of contamination and tampering. A disadvantage which arises is that if the reservoir is left in the dispenser until the reservoir is empty, then there is no fluid to be dispensed. Typically, the reservoir is replaced while there is still soap in the reservoir so as to ensure that the dispenser will always have soap for dispensing. This has a disadvantage in resulting in discarding of used reservoirs containing soap. Similar disadvantages arise with known dispensers for a multitude of different products including fluid materials such as liquid hand cleaners, pastes, flowable particulate matter, alcohol solutions for disinfecting, industrial cleaners, and fluid food products such as milk, ketchup, mustard and the like.

SUMMARY OF THE INVENTION

To at least partially overcome these disadvantages of previously known devices, the present invention provides a vacuum controlled valve mechanism providing two separate one-way valves, one for each of a pair of collapsible fluid containing reservoirs with each valve being in an initial sealed condition preventing flow therethrough until by operation of the pump mechanism a threshold vacuum is exceeded and with the threshold vacuum of a first of the valves being greater than the threshold vacuum of the other, second of the valves. When the threshold vacuum of the first valve is exceeded, that first valve separately permits dispensing of fluid from its reservoir under vacuum conditions less than the threshold vacuum of the first valve and the second valve until the first reservoir is substantially empty after which further operation of the pump mechanism creates a vacuum which exceeds the threshold vacuum for the second valve after which the second valve permits dispensing of fluid from the second reservoir.

An object of the present invention is to provide a simplified vacuum controlled valve mechanism to selectively permit dispensing from one of a plurality of fluid containing reservoirs.

Another object of the present invention is to provide a dispenser for fluid which, in normal operation of a pump mechanism to dispense fluid selectively, dispenses fluid first from a first reservoir and on its emptying, subsequently, from a second reservoir.

Another object is to provide a dispenser which can easily be converted for dispensing from a single reservoir or two reservoirs.

The present invention provides a dispenser for dispensing fluids with a pump mechanism operative for pumping fluid from a chamber out of an outlet thereby creating a vacuum below atmospheric in the chamber. At least two collapsible fluid containing reservoirs are provided enclosed but for having an outlet passage in communication with the chamber. A separate one-way valve for each reservoir provides flow from each reservoir to the chamber when certain vacuum conditions exist in the chamber. Each one-way valve has an initial sealed condition preventing flow therethrough until a threshold vacuum for that valve is exceeded in the chamber by operation of the pump mechanism. From an initial arrangement in which each reservoir is full of fluid to be dispensed and each one-way valve is in the initial sealed condition, by operation of the pump mechanism, a vacuum is created until the threshold vacuum of one valve is exceeded at which time that valve permits dispensing of fluid from its reservoir by further operation of the pump mechanism with such dispensing occurring with the pump mechanism creating vacuum conditions less than the threshold value of that valve and the other valves until its reservoir is substantially emptied. Thereafter, further operation of the pump mechanism creates a vacuum in the chamber which exceeds the threshold vacuum for another of the valves after which, by further operation of the pump mechanism, such other of the valves permits dispensing of fluid from its reservoir. Each separate one-way valve is thus retained in its initial sealed condition until a relatively high threshold vacuum is generated by operation of the pump mechanism. The initial relatively high threshold vacuum for each of the one-way valve is different than for other of the one-way valves.

The threshold vacuum for any one of the one-way valves may vary as a function of the nature of its reservoir and the mechanical construction of its one-way valve. Even though any two such reservoirs and one-way valves may be constructed as from identical moulds to create substantially identical products, it is to be appreciated that the threshold vacuum of any two reservoirs may, nevertheless, vary by even a small amount. This small difference in the threshold vacuum of two one-way valves is utilized as the feature by which one of the one-way valves is selectively opened prior to the other.

After the threshold vacuum of any one-way valve is exceeded, that one-way valve moves from an initial sealed condition preventing flow therethrough to an openable condition in which the one-way valve, while being biased to a closed position, will under vacuum conditions in the chamber move to an open position to permit fluid to be drawn therethrough from the reservoir into the chamber. The vacuum in the chamber required to draw fluid past the one-way valve when in the openable condition is less than the threshold vacuum for that valve or for any of the other valves. Thus, in operation, from an initialled sealed condition when all of the one-way valves are closed, on generation of a vacuum in the chamber, the one-way valve which has the lowest threshold vacuum will move from its sealed condition to the openable condition. In the openable condition, the valve is movable between the closed position and open positions but is biased to the closed position. In a one-way valve moving from the initial sealed condition to the openable condition, there will typically be some initial dispensing of fluid into the chamber until the vacuum may decrease to a sufficient vacuum below atmospheric that the one-way valve moves to the closed position. Subsequently, by operation of the pump, fluid is drawn from the one respective reservoir and dispensed out of the chamber under vacuum conditions in the chamber less than the threshold vacuum of any of the other one-way valves but greater than that required to move the one-way valve from the closed position to an open position. On all the fluid from the one reservoir from which fluid is being dispensed being exhausted, with collapsing of that reservoir, operation of the pump mechanism will cause the vacuum in the chamber to rise until that vacuum exceeds the threshold vacuum for a one-way valve for another of the reservoirs with the result that this next one-way valve will be moved from its initial sealed condition to the openable condition and dispensing through that one-way valve from its reservoir may continue under vacuum conditions in the chamber which will be less than the threshold vacuum of any remaining one-way valves. In this manner, at least two reservoirs may be joined to the same chamber and as many reservoirs as may be desired may be joined to the same chamber with each reservoir being selectively emptied of its fluid in sequence depending upon the relative threshold vacuum for each of the one-way valves for each of the reservoirs.

The primary one-way valve for each reservoir preferably is disposed across an outlet passageway of each reservoir and assumes either a sealed condition or an openable condition. In the sealed condition, the one-way valve closes the outlet against fluid flow therethrough and is biased to remain in the sealed condition unless the valve is subjected on the chamber side of the valve to a vacuum greater than its threshold vacuum. Once the threshold vacuum is reached, the first valve moves from its sealed condition to the openable condition. In the openable condition, the valve is movable between a closed position and an open position. In the closed position, the first valve closes the outlet against fluid flow therethrough. The valve is biased to return to and remain in the closed position and against moving from the closed position towards an open position other than when subjected to a vacuum below atmospheric sufficient to move the valve to the open position but less than the threshold value for that valve or any other valves.

In accordance with the present invention, a fluid dispenser is provided with preferably a pair of collapsible reservoirs. Each reservoir preferably is removably coupled to the chamber. The one-way valve mechanism for each reservoir may be carried with the reservoir and be removable therewith or may be provided separate from the reservoir as a portion of the chamber.

In accordance with the present invention, when one of the reservoirs in the openable condition, the other reservoirs are replaceable with a new reservoir, and dispensing will resume from the one reservoir.

In a first aspect, the present invention provides a dispenser or dispensing fluids comprising:

a dispenser for dispensing fluids comprising:

a pump mechanism operative for pumping fluid from a chamber out of an outlet thereby creating vacuum conditions below atmospheric in the chamber, at least two collapsible fluid containing reservoirs enclosed but for each having an outlet passageway in communication with the chamber, a primary one-way valve for each reservoir permitting flow of fluid from each reservoir through the passageway to the chamber when certain vacuum conditions exist in the chamber relative the reservoir, each one way valve being in an initial sealed condition preventing flow from its respective reservoir until a threshold vacuum for that valve is exceeded in the chamber by operation of the pump mechanism, the threshold vacuum for each valve being different than the threshold vacuum of all the other valves, wherein after the threshold vacuum of one of the valves is exceeded by operation of the pump mechanism, that valve permitting flow of fluid from its reservoir by further operation of the pump mechanism to create vacuum conditions less than the threshold value of that valve and the other valves until its reservoir is substantially emptied whereafter further operation of the pump mechanism creates a vacuum in the chamber which exceeds the threshold vacuum for another of the valves after which such other of the valves permitting flow of fluid from its reservoir by operation of the pump mechanism.

Preferably, in accordance with the first aspect, each valve assumes either a sealed condition or an openable condition, in the sealed condition each valve prevents flow of fluid from its respective reservoir through its passageway to the chamber and is biased to remain in the sealed condition against moving to the openable condition unless the valve is subjected on its chamber side to a vacuum below atmospheric greater than the threshold vacuum for the valve whereupon the valve moves from the sealed condition to the openable condition, in the openable condition:

(a) each valve is movable between a closed position and an open position, (b) each valve is biased to return to and remain in the closed position and against moving from the closed position toward the open position other than when subjected to a vacuum below atmospheric greater than an opening vacuum of the valve when the valve moves from the closed position toward the open position permitting flow of fluid from its respective reservoir through its passageway to the chamber, (c) in the closed position each valve prevents flow of fluid from its respective reservoir through its passageway to the chamber, and (d) in the open position, each valve permits flow of fluid from its respective reservoir through its passageway to the chamber, the threshold vacuum of each valve being a greater vacuum below atmosphere than its opening vacuum and the opening vacuum of all other valves.

BRIEF DESCRIPTION OF THE DRAWINGS

Further aspects and advantages of the present invention will become apparent from the following description taken together with the accompanying drawings in which.

DETAILED DESCRIPTION OF THE DRAWINGS

Figure 1:
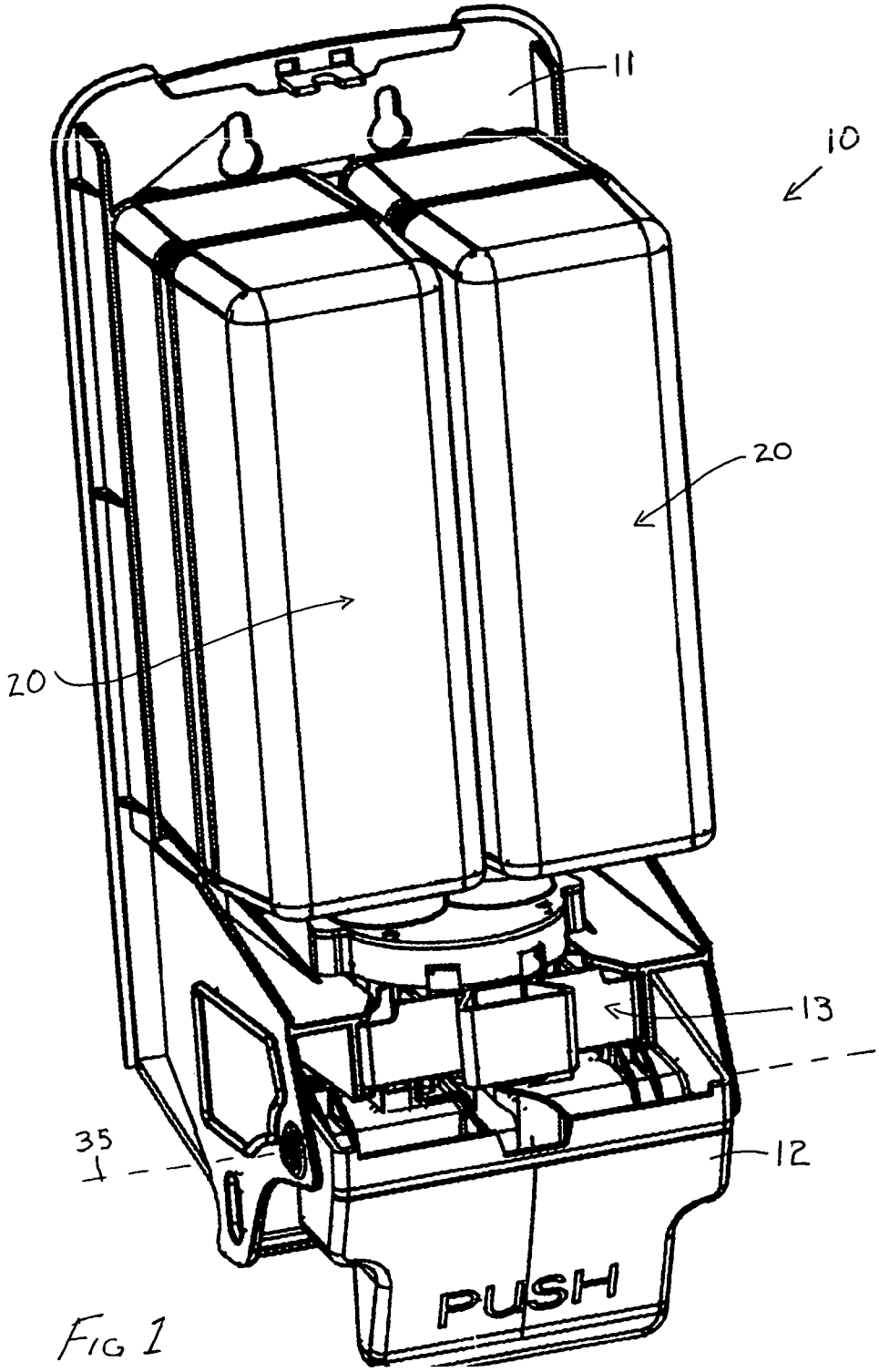
FIG. 1 is a pictorial view of a dispenser in accordance with a first embodiment of the present invention.
Figure 2:
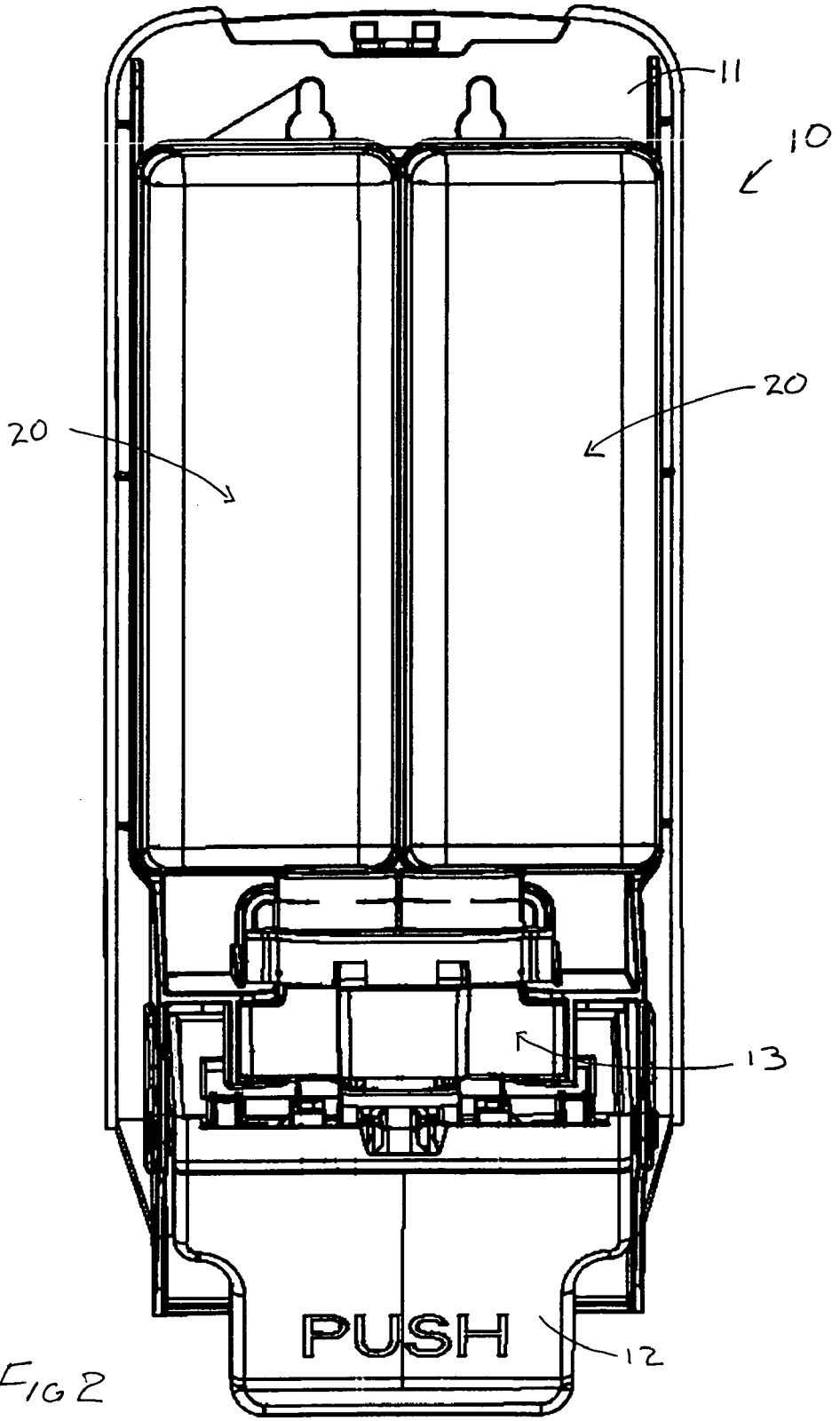
FIG. 2 is a front view of the dispenser of FIG. 1.
Figure 3:
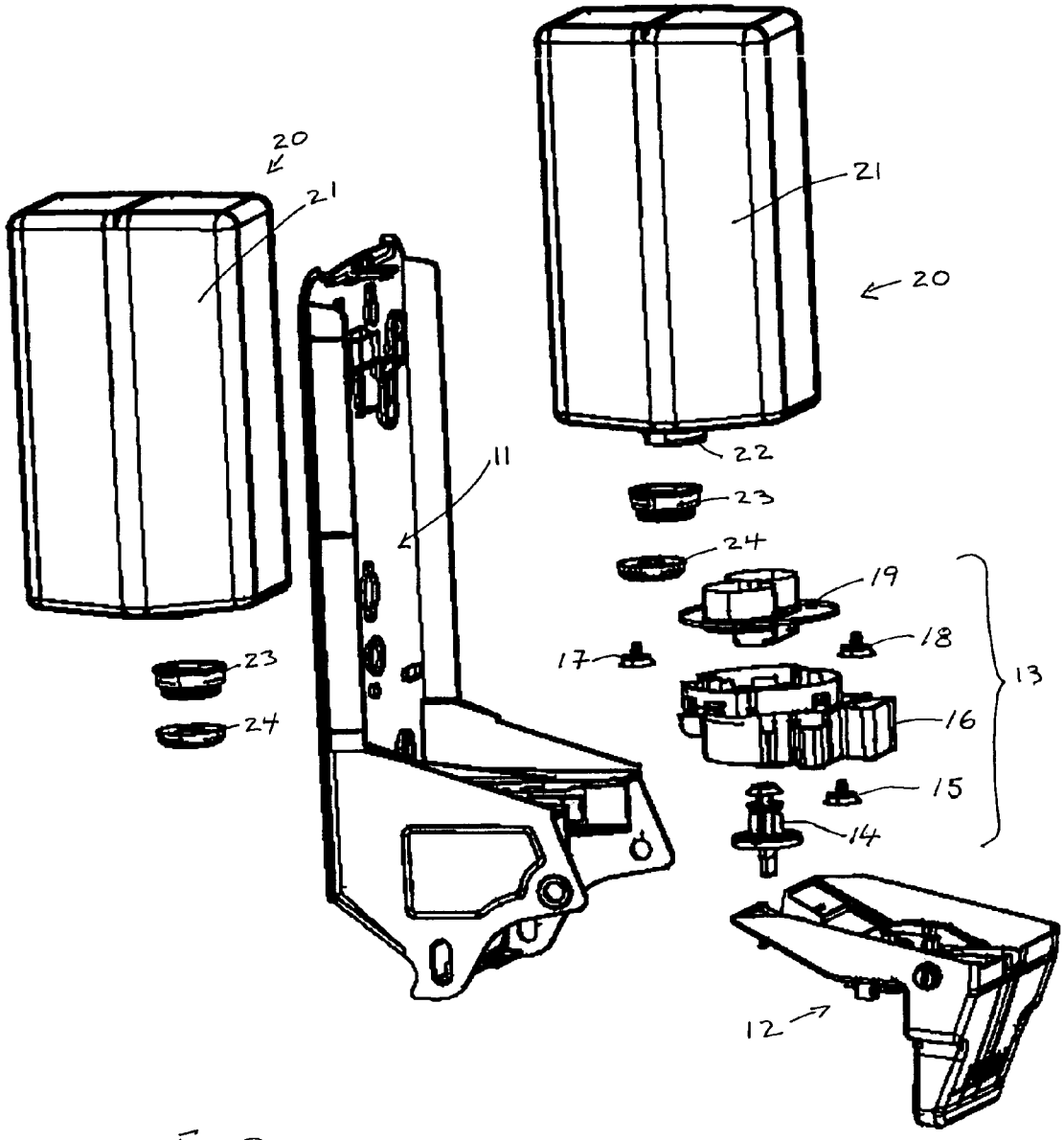
FIG. 3 is a schematic exploded view of the dispenser of FIG. 1.

Reference is made to FIGS. 1, 2 and 3 which show a fluid dispenser 10 in accordance with a first embodiment of the present invention in pictorial, front and exploded views, respectively. The dispenser 10 includes a housing member 11, a lever member 12, a pump mechanism 13 and two reservoir units 20. The pump mechanism 13 includes a piston 14, a piston cup valve 15, a chamber base 16, two chamber cup valves 17 and 18, and a chamber lid 19. Each reservoir unit 20 comprises a collapsible bottle 21 with an outlet opening 22, a seat member 23 and a seal member 24.

Figure 4:
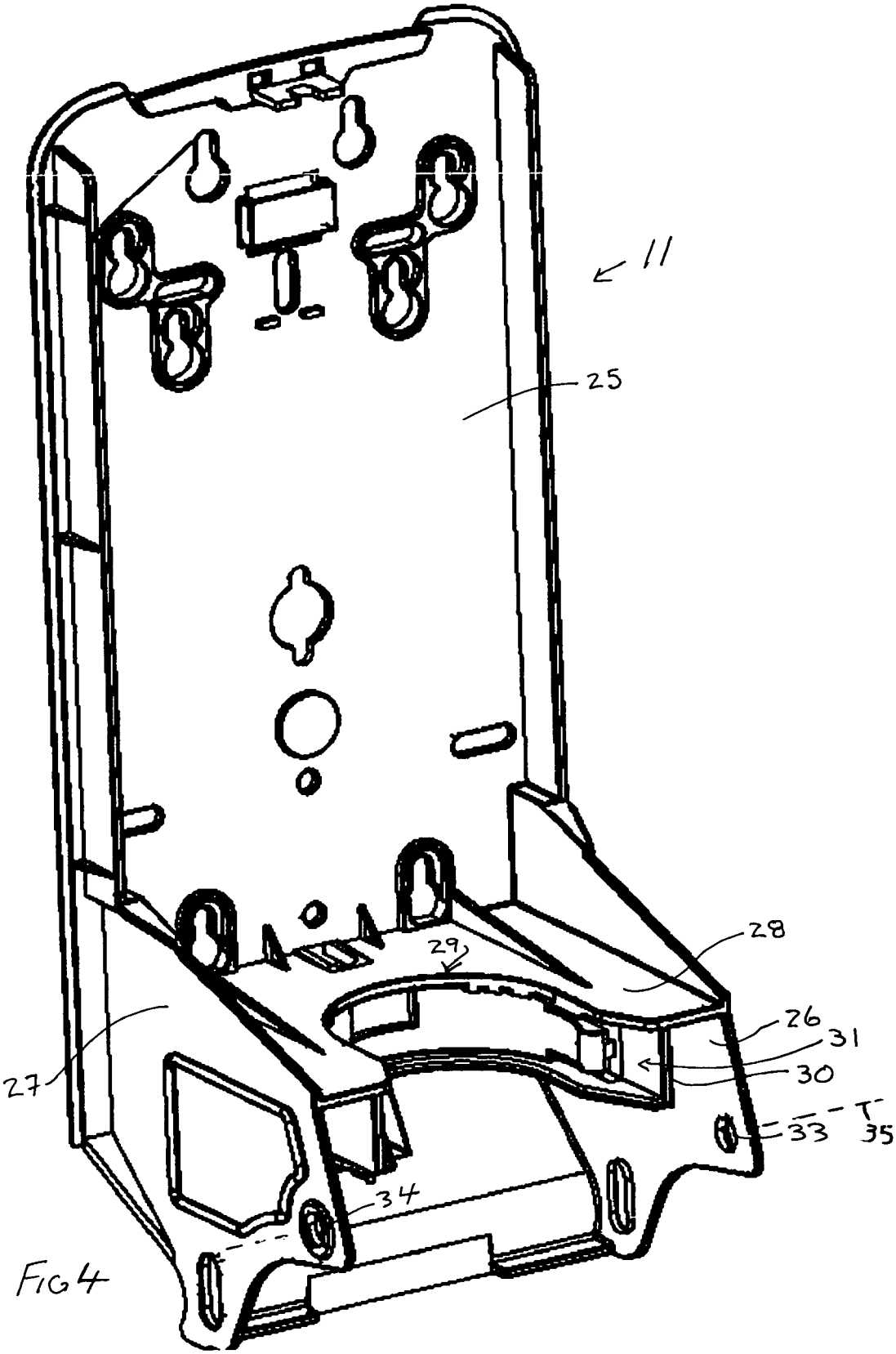
FIG. 4 is a pictorial view of the housing member shown in FIG. 3.

As seen in FIG. 4, the housing 11 has a back plate 25 from which two side members 26 and 27 extend forwardly and are bridged by a forwardly extending support plate 28. The support plate 28 has a forwardly directed generally U-shaped opening 29. An L-shaped flange member 30 extends downwardly from the support plate 28 about the opening 29 to define with the support plate 28 a channelway 31 about the opening 29 to receive and support the pump mechanism 13 when the pump mechanism is slid rearwardly into the opening 29 and its channelway 31.

Figure 5:
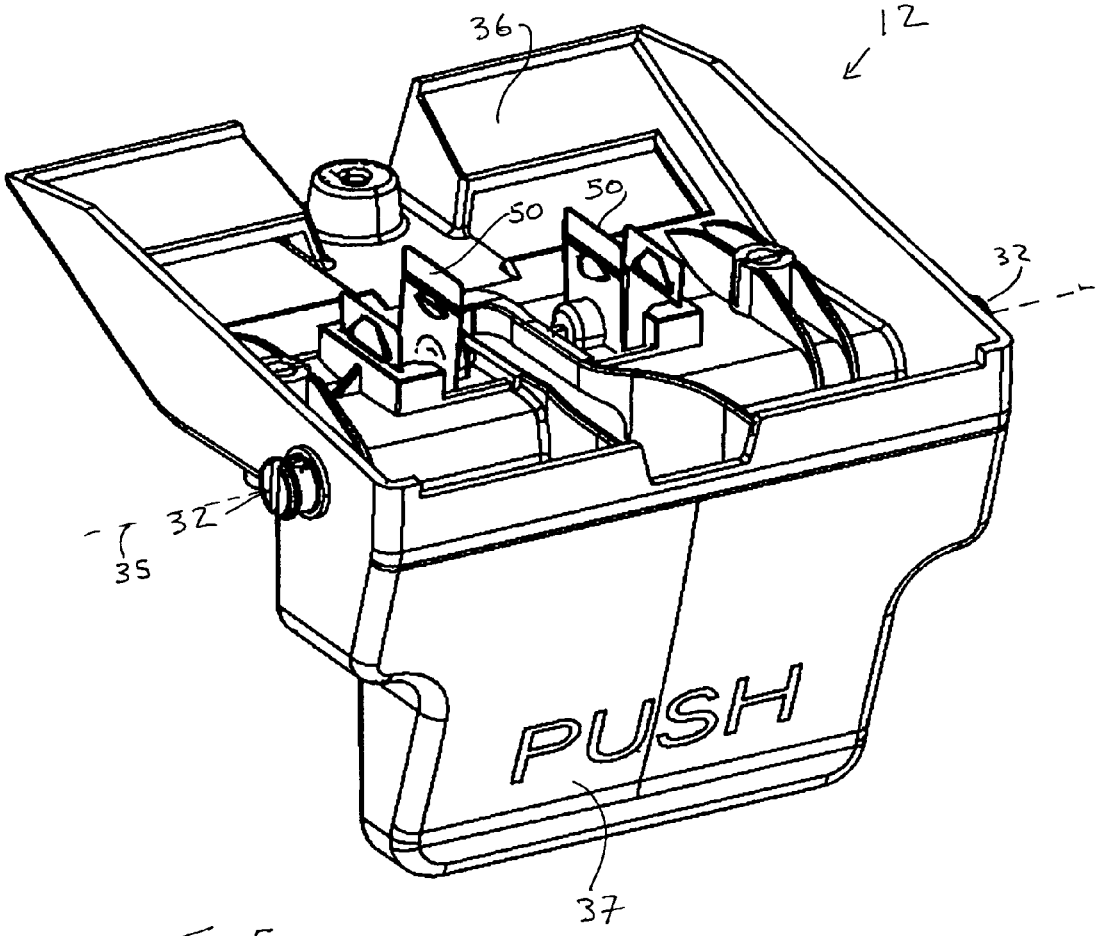
FIG. 5 is a pictorial view of the lever member shown in FIG. 3.
Figure 6:
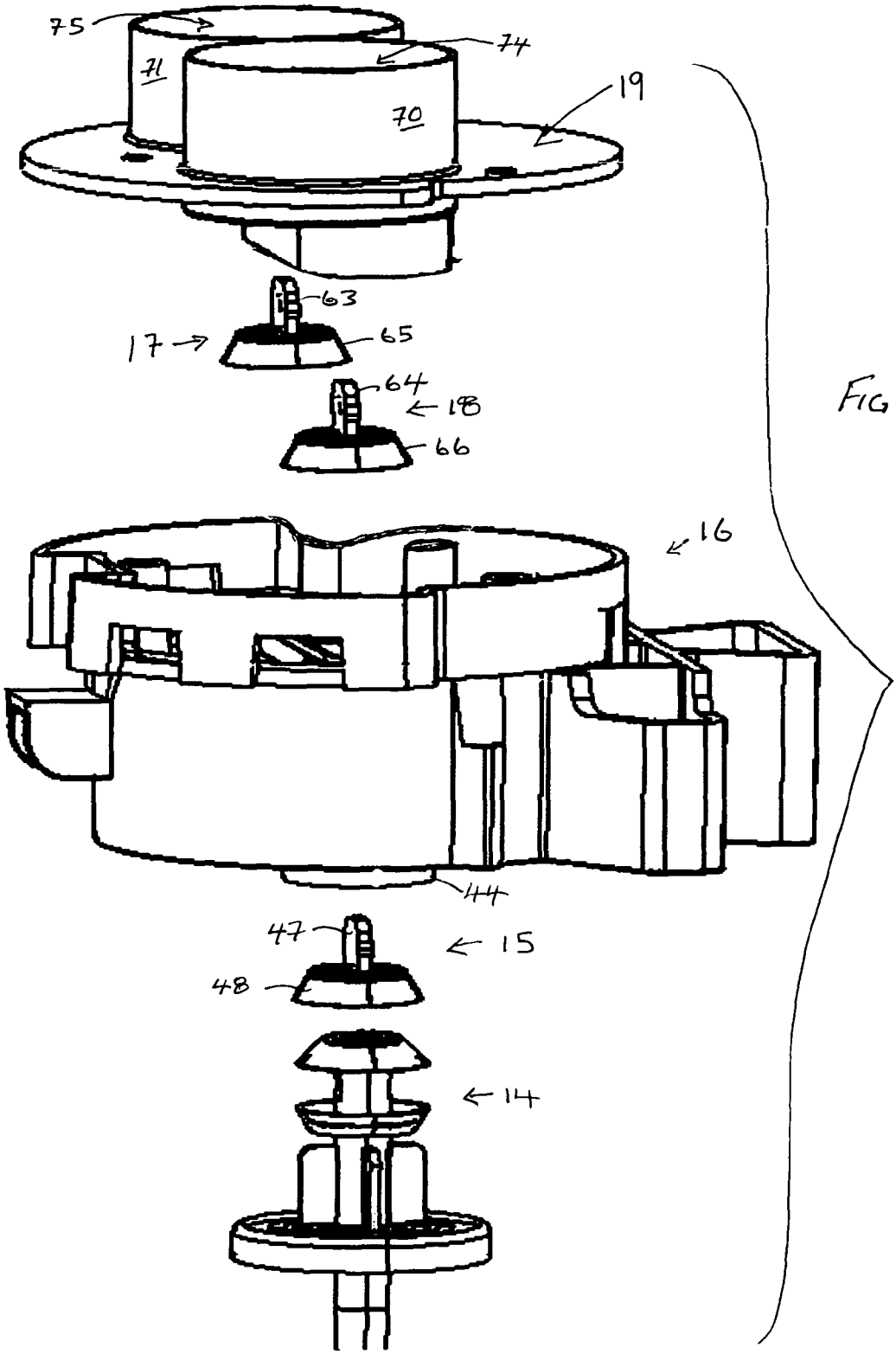
FIG. 6 is an enlarged pictorial exploded view of the components of the pump mechanism shown in FIG. 3.
Figure 7:
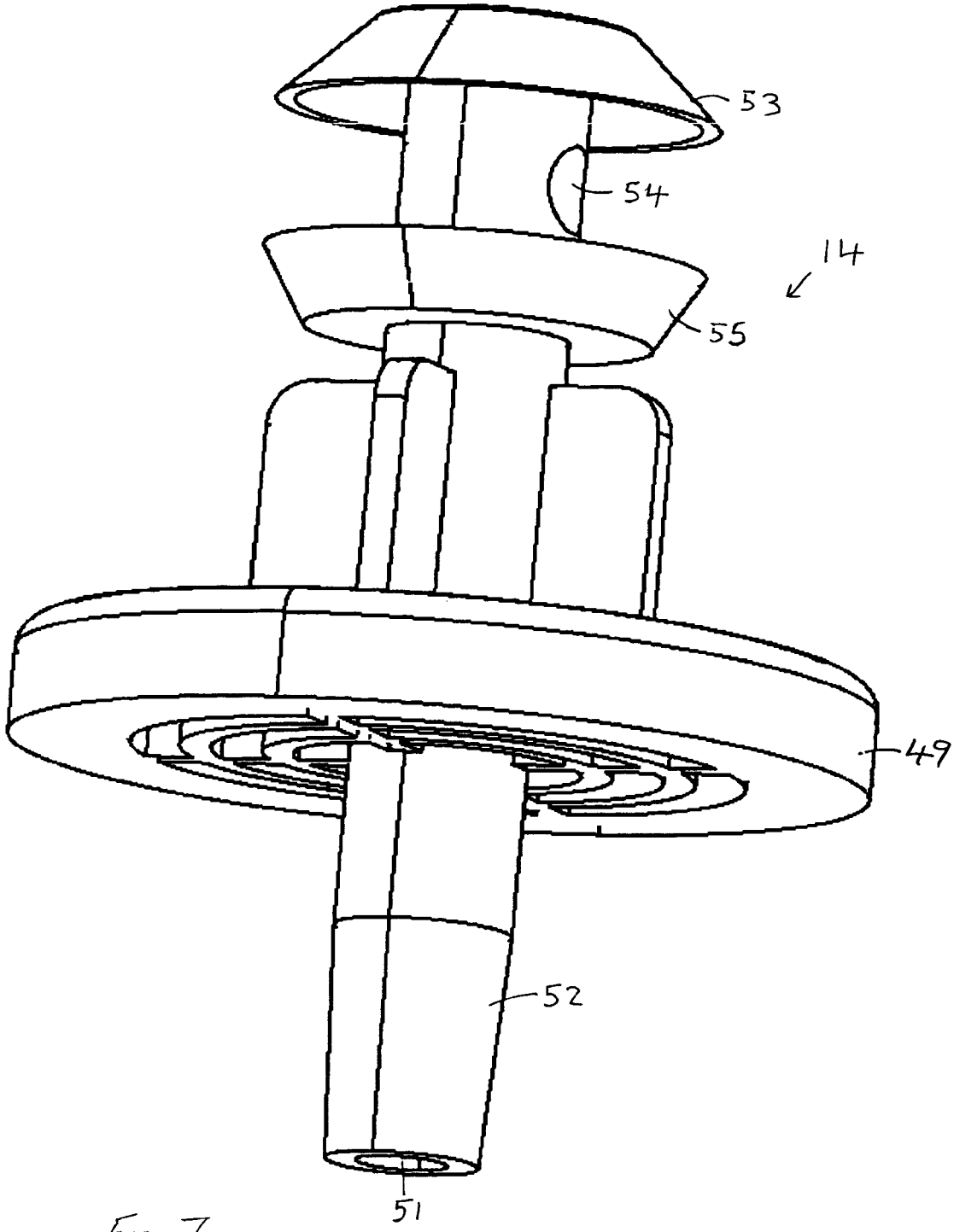
FIG. 7 is an enlarged pictorial view of the piston shown in FIGS. 3 and 6.
Figure 8:
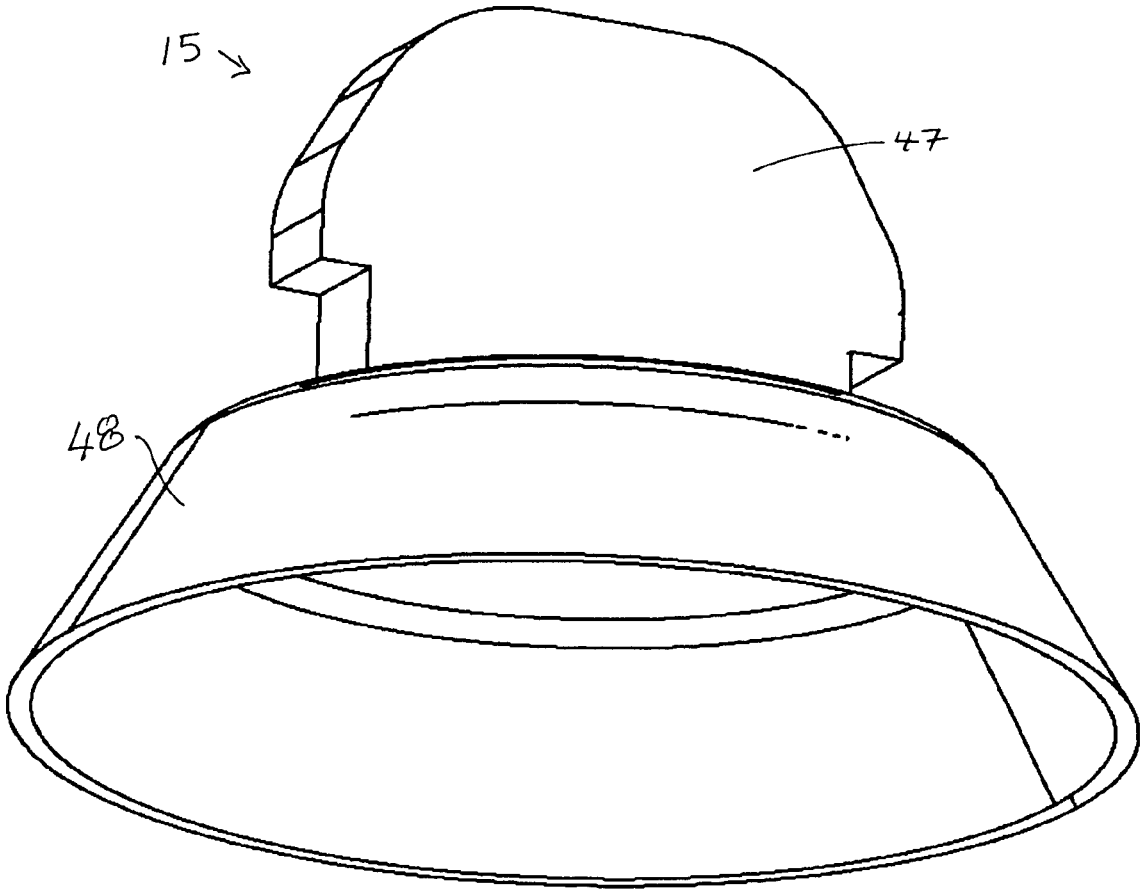
FIG. 8 is an enlarged pictorial view of one of the three one-way valve members shown in FIGS. 3 and 6.

As seen with reference to FIGS. 4 and 5, the lever member 12 carries two stub axles 32 on each side which journal in recesses 33 and 34 in the side members 26 and 27 of the housing 11 such that the lever member 12 is pivotally mounted to the housing 11 for pivoting about horizontal axis 35. The inner end 36 of the lever member 12 is adapted to engage the piston 14 such that manual rearward pushing of the outer end 37 of the lever member 12 moves the piston 14 within the pump mechanism 13. A spring member, not shown, biases the lever member 12 to pivot and move the outer end 37 forwardly to return to an extended position when released from manual engagement by a user's hand.

Figure 9:
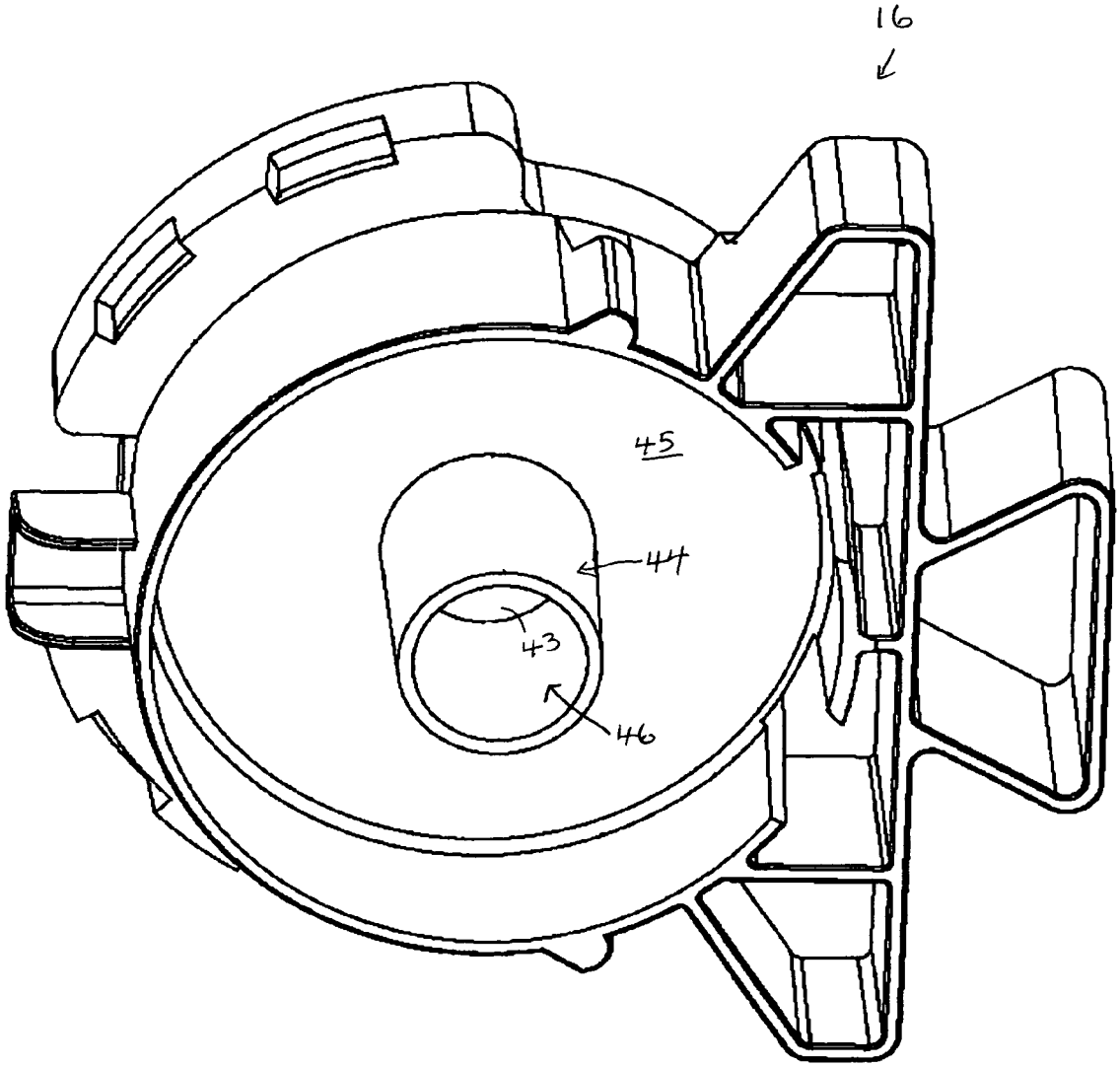
FIG. 9 is a pictorial bottom view of the chamber base member shown in FIG. 6.
Figure 10:
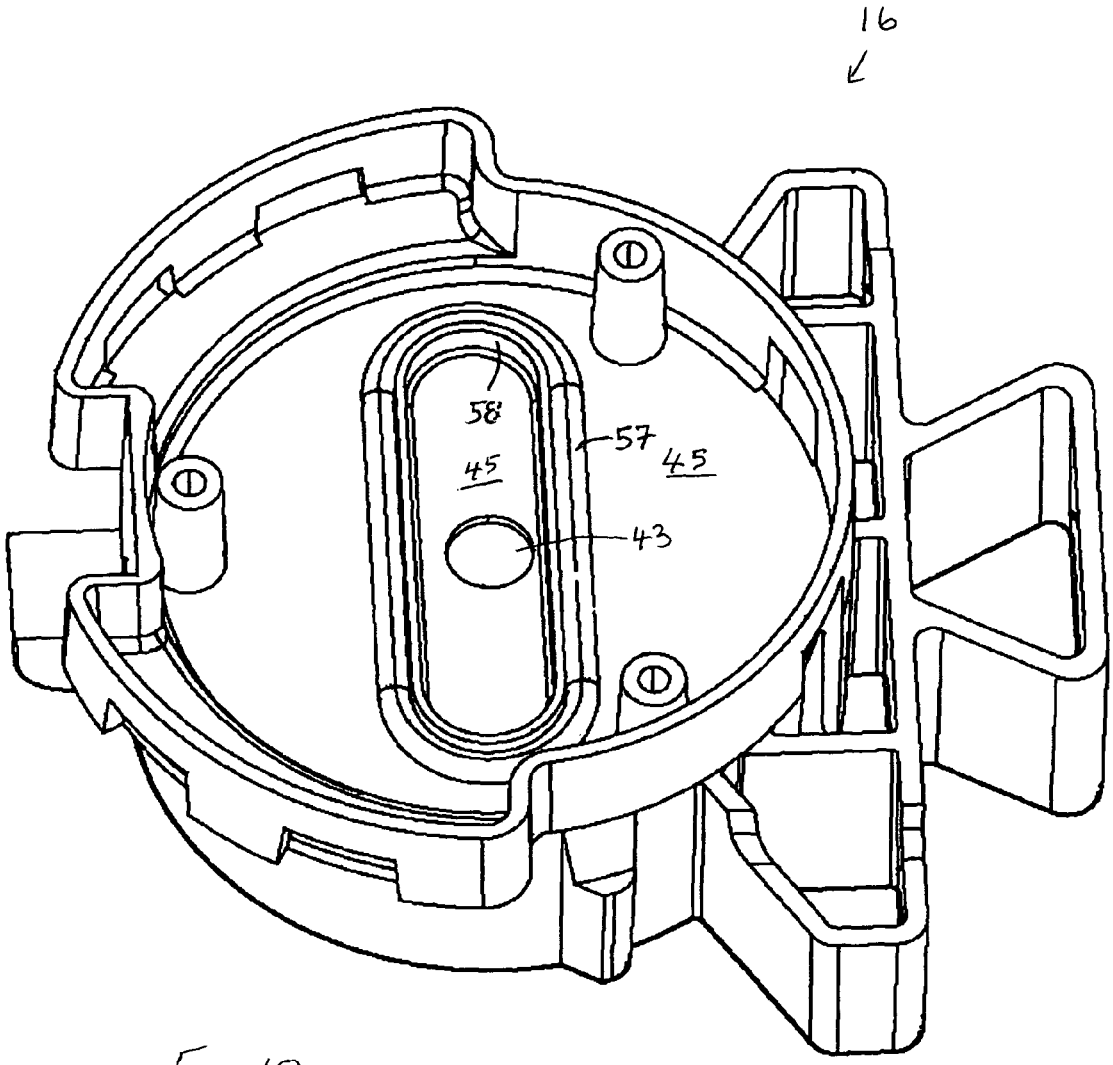
FIG. 10 is a pictorial top view of the chamber base member shown in FIG. 9.
Figure 11:
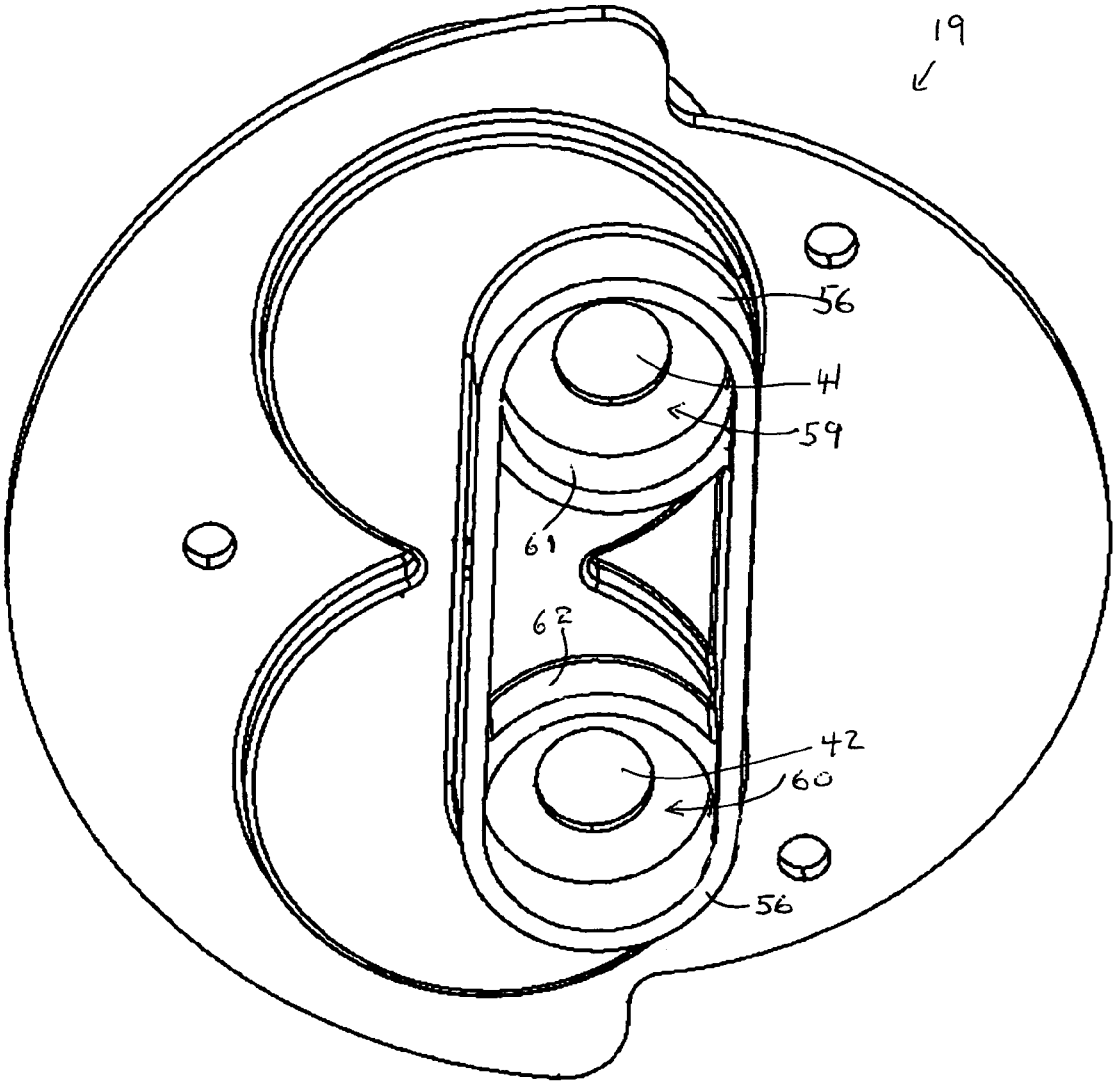
FIG. 11 is a pictorial bottom view of the chamber lid shown in FIG. 6.
Figure 12:
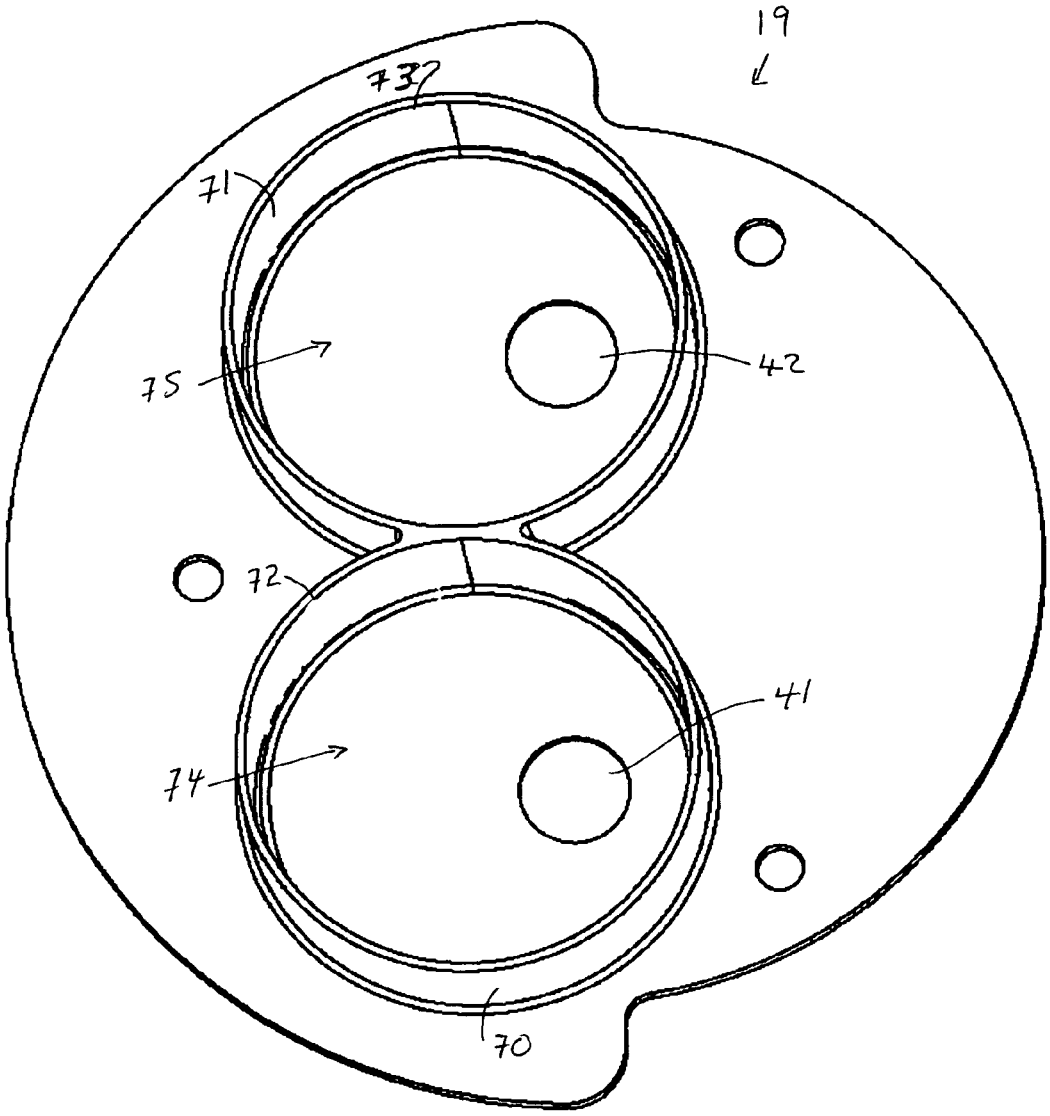
FIG. 12 is a pictorial top view of the chamber lid shown in FIG. 11.
Figure 13:
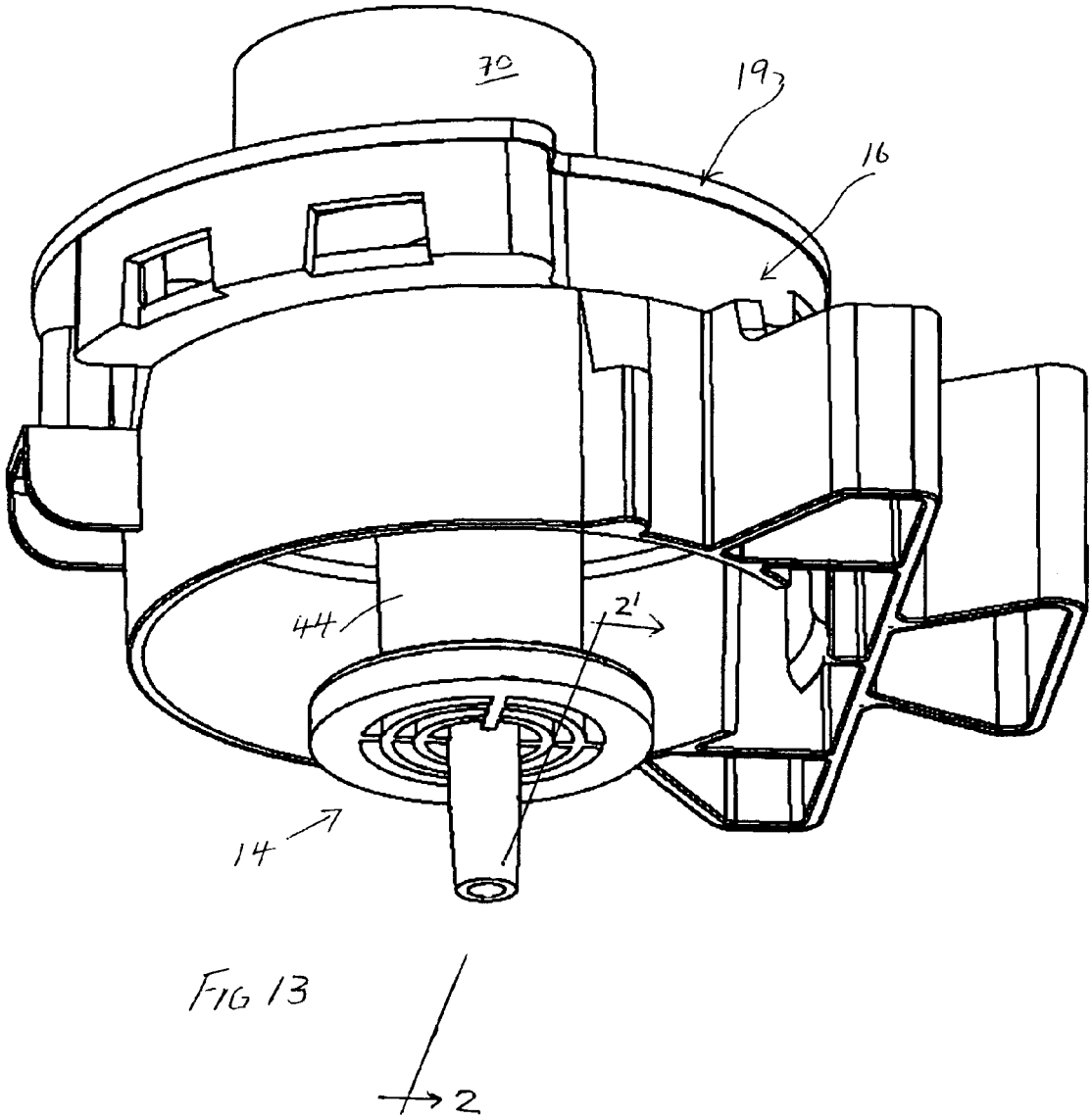
FIG. 13 is a pictorial view of the assembled pump mechanism shown in FIG. 6.
Figure 22:
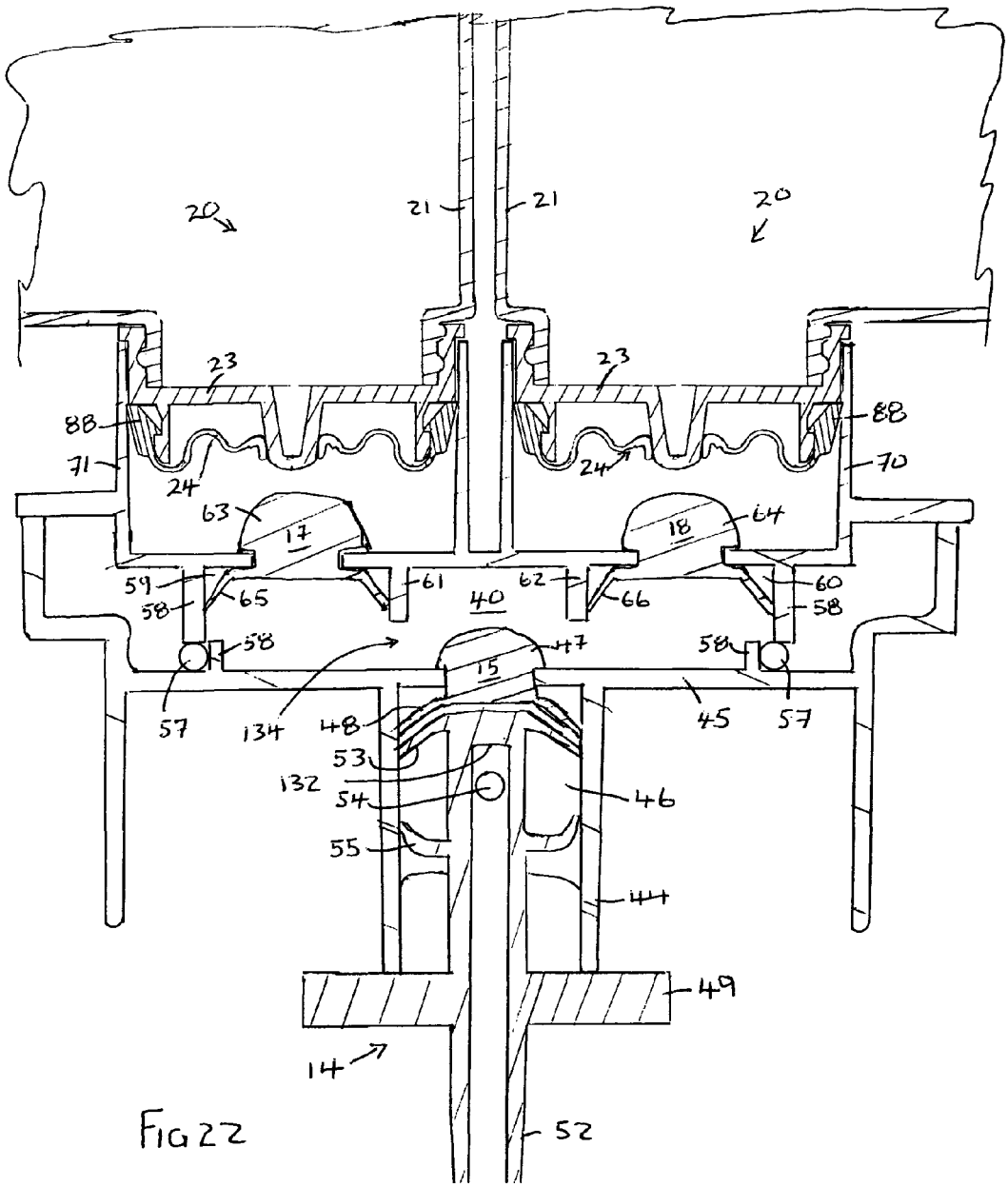
FIG. 22 is a cross-sectional side view through the pump mechanism along section line 2-2' in FIG. 13 and showing the two reservoir units coupled thereto.

Reference is made to FIGS. 6 to 13 showing the pump mechanism 13 and its components. The chamber lid 19 is secured to the chamber base 16 to form a racetrack shaped main chamber 40 therebetween as best seen in side view in FIG. 22. As seen in FIGS. 11 and 12, two inlet openings 41 and 42 are provided through the chamber lid 19 into the chamber 40 and an outlet opening 43 is provided through the chamber base 16 into the chamber 40. As seen in FIG. 9, a cylindrical tube 44 extends downwardly from a floor 45 of the chamber base 16 which tube 44 is cylindrical about the outlet opening 43 and forms a cylindrical pump chamber 46. As seen in FIG. 22, the piston cup valve 15 is secured in the pump chamber 46 with its catch end 47 extending through the outlet opening 43 and its frustoconical valve seat portion 48 in the piston chamber 46 resiliently engaging the inside surfaces of the tube 44 to form a one-way valve therein which prevents fluid flow inwardly therepast, that is, from the pump chamber 46 into the main chamber 40, but permits fluid flow outwardly therepast when the bias of the resilient frustoconical seat portion 48 into the tube 44 is overcome by a pressure differential between the main chamber 40 and the piston chamber 46.

As seen in FIG. 22, the piston 14 is slidably received in the tube 44 outwardly of the piston cup valve 15 with an engagement flange 49 on the piston 14 disposed exterior of the tube 44 for engagement between spring catches 50 carried on the inner end of the lever member 12 as seen in FIG. 5. The engagement flange 49 on the piston 14 is adapted to be engaged between spring catches 50 carried on the lever member 12 to couple the piston 14 to the lever member 12 in a manner as described in U.S. Pat. No. 5,431,309 issued Jul. 11, 1995, the disclosure of which is incorporated herein. Reciprocal axially inward and outward movement of the piston 14 in strokes of operation by the lever member 12 will dispense fluid from the main chamber 40 out of an outlet opening 51 of an outlet tube 52 of the piston 14. Fluid flow is past a resilient inner flange 53 of the piston, best seen in FIG. 7, to an inlet 54 which communicates internally via an internal bore 130 shown in FIG. 22 to the outlet opening 51. The internal bore is closed at 132 inwardly of inlet 54. An outer sealing disc 55 on the piston 14, best seen in FIG. 7, prevents fluid flow outwardly in the tube 44 as seen in FIG. 22.

The piston 14, tube 44 and piston cup valve 15 form a three element piston pump as, for example, described in the applicant's U.S. Pat. No. 5,165,577 issued Nov. 24, 1992, the disclosure of which is incorporated herein by reference.

The fluid chamber 40 is formed between the underside of the chamber lid 19 and the chamber base 16 inside a racetrack shaped side wall 56 which extends downwardly from the chamber lid 19, as seen in FIG. 11, to seal on a resilient O-ring 57 stretched about a similar racetrack shaped wall 58 extending upwardly from the floor 45 of the chamber base 16 as seen in FIG. 10. Extending downwardly on the chamber lid 19 coaxially about each inlet opening 41 and 42 are cylindrical valve seat chambers 59 and 60 as seen in FIG. 11. These cylindrical valve seat chambers 59 and 60 are formed in part by the curved end portions of the side wall 56 and in part by half circular cylindrical walls 61 and 62, respectively, which walls 61 and 62 extend downwardly only so far as to leave passageways 134 for flow between their lower ends and the upper surface of the floor 45 of the chamber base 16 inside the side wall 56. As seen in FIG. 22, each chamber cup valve 17 and 18 are secured in the inlet openings 41 and 42 with their catch ends 63 and 64 extending upwardly through the inlet openings 41 and 42 and their resilient frustoconical valve seat portions 65 and 66 inside the cylindrical valve seat chambers 59 and 60 resiliently engaging the walls to each form a one-way valve therein which prevents fluid flow inwardly therepast but permits fluid flow outwardly therepast under a pressure differential sufficient to overcome the bias of the resilient frustoconical seat portions 65 or 66 into the walls.

As seen in FIG. 12, on the chamber lid 19, about each of the inlet openings 41 and 42, a pair of cylindrical reservoir junction tubes 70 and 71 extend upwardly from the upper side of the chamber lid 18 to uppermost openings 72 and 73 defining junction cavities 74 and 75 therein.

Figure 18:
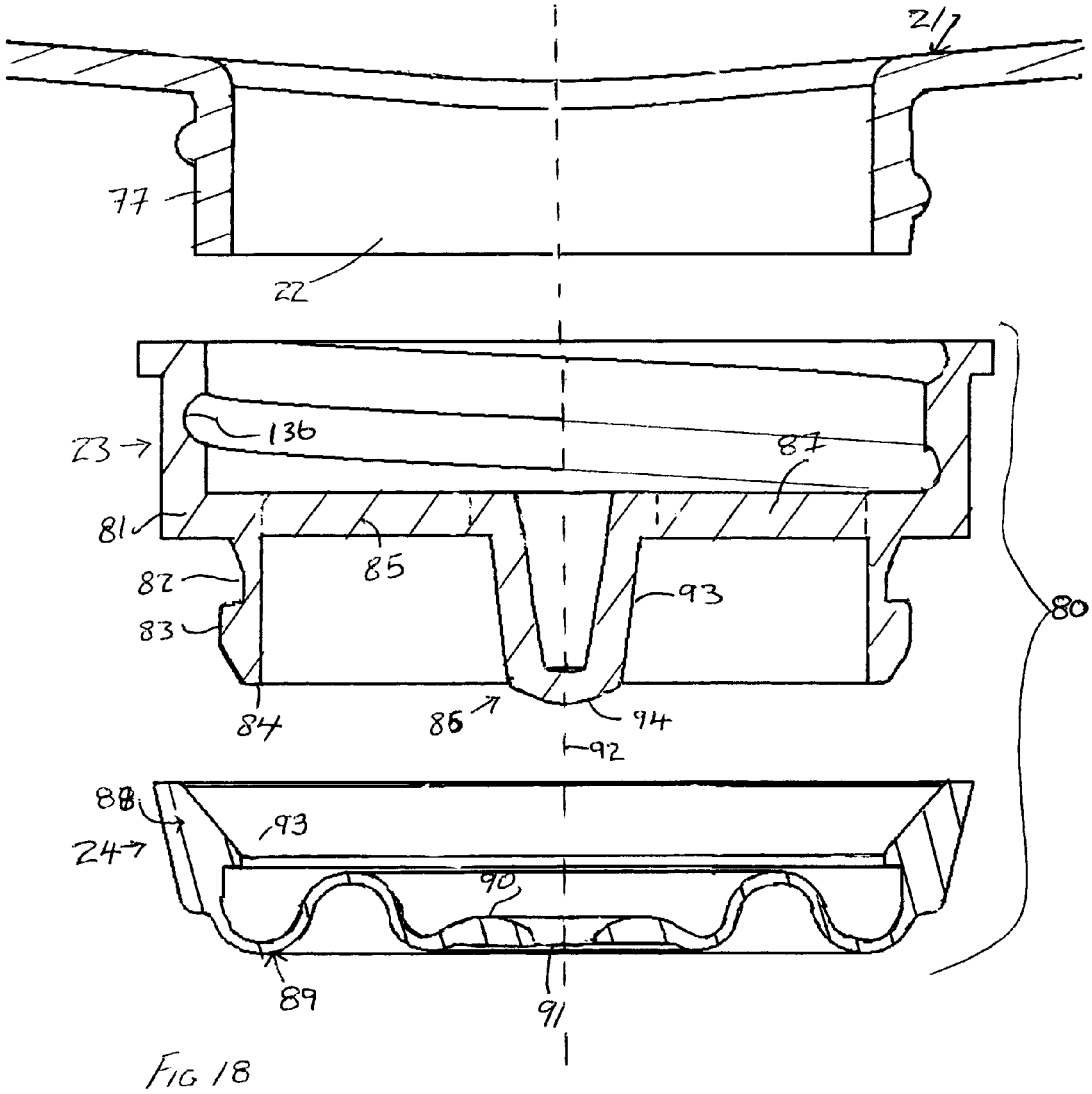
FIG. 18 is an enlarged exploded cross-sectional side view of each of the neck of the bottle, the seat member and the seal member, each shown in FIG. 3, but coaxially aligned ready for assembly.

Reference is made to FIGS. 14 to 21 showing components of the two reservoir units 20. As seen in FIG. 3, each reservoir unit 20 includes a collapsible bottle 21 preferably of plastic material which is enclosed but for an outlet opening 22. As seen in FIG. 18, the bottle 20 has a threaded neck 77 about the opening 22.

A valve mechanism 80 for the bottle 20 is formed by the seat member 23 and the seal member 24. The seat member 23 is preferably a rigid member formed from plastic and having an annular side wall 81 which is internally threaded as at 136 so as to threadably couple the seat member 23 onto the threaded neck 77 of the bottle 20. The annular side wall 81 has a radially inwardly directed groove 82 in its outer surface 83 spaced inwardly from an outer end 84 of the side wall 81. Arms 85 extend radially inwardly from the side wall 81 to support a valve stem 86 which extends coaxially outwardly. Openings 87 between the arms 85 permit fluid flow therepast.

Figure 14:
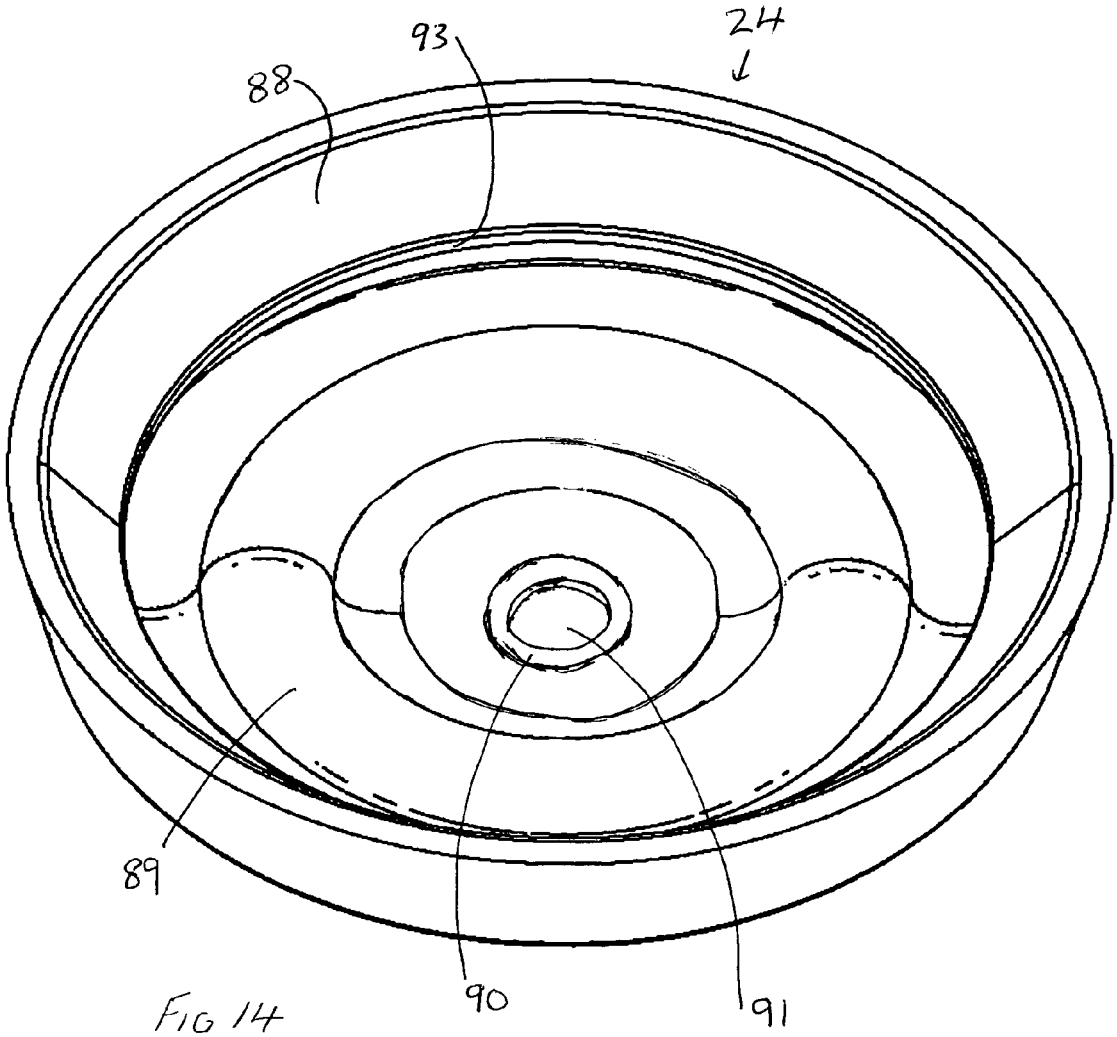
FIG. 14 is a perspective top view of the seal member shown in FIG. 3.
Figure 15:
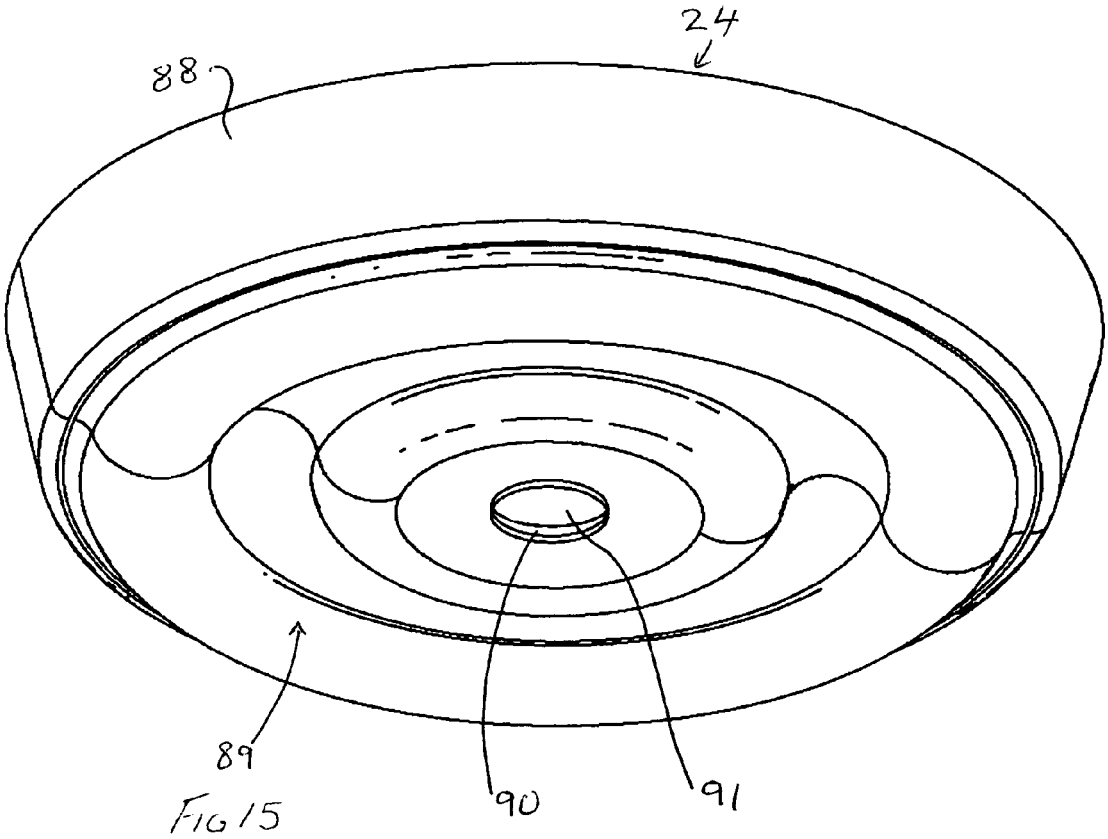
FIG. 15 is a pictorial bottom view of the seal member shown in FIG. 14.
Figure 16:
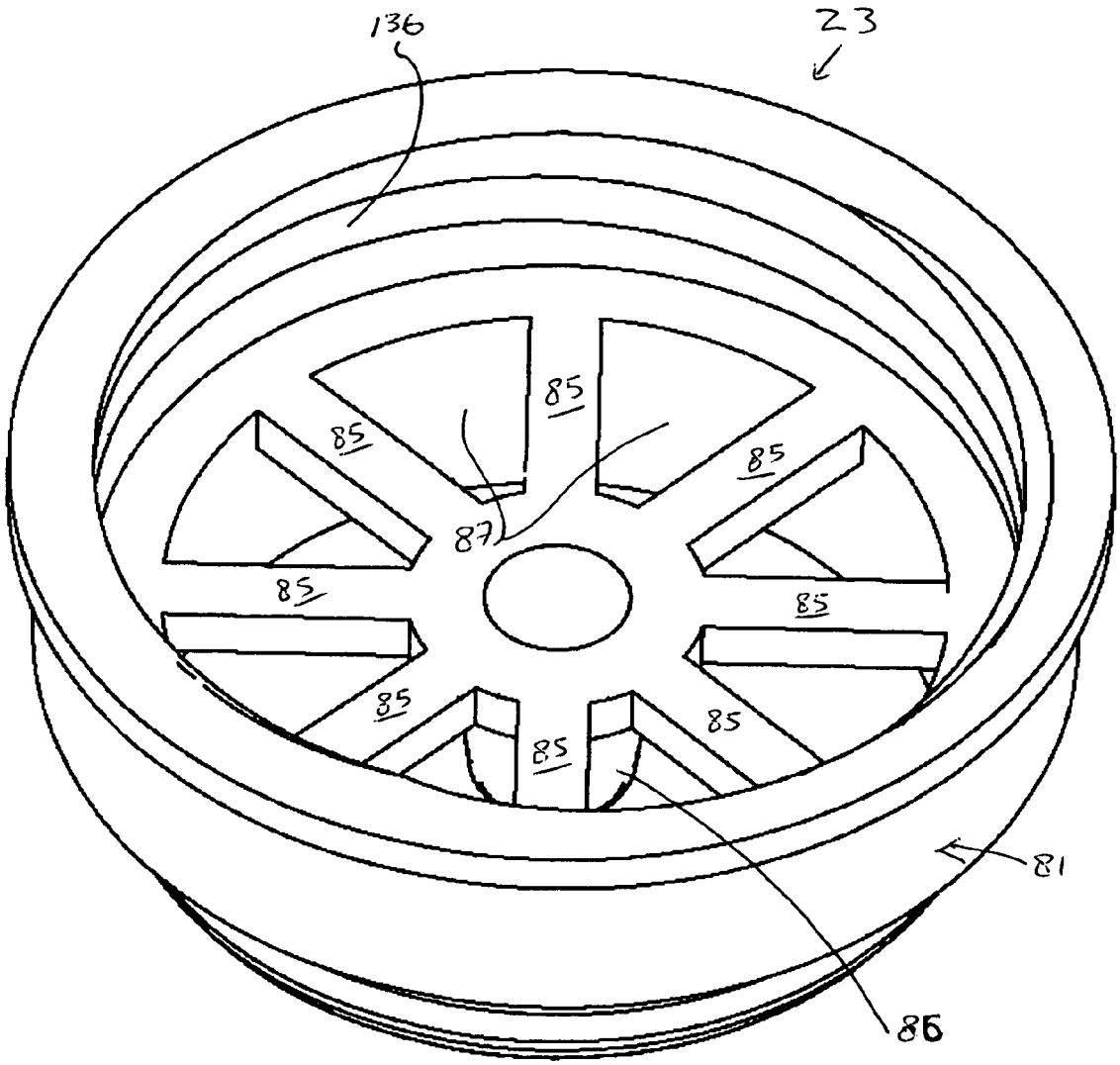
FIG. 16 is a perspective top view of the seat member shown in FIG. 3.
Figure 17:
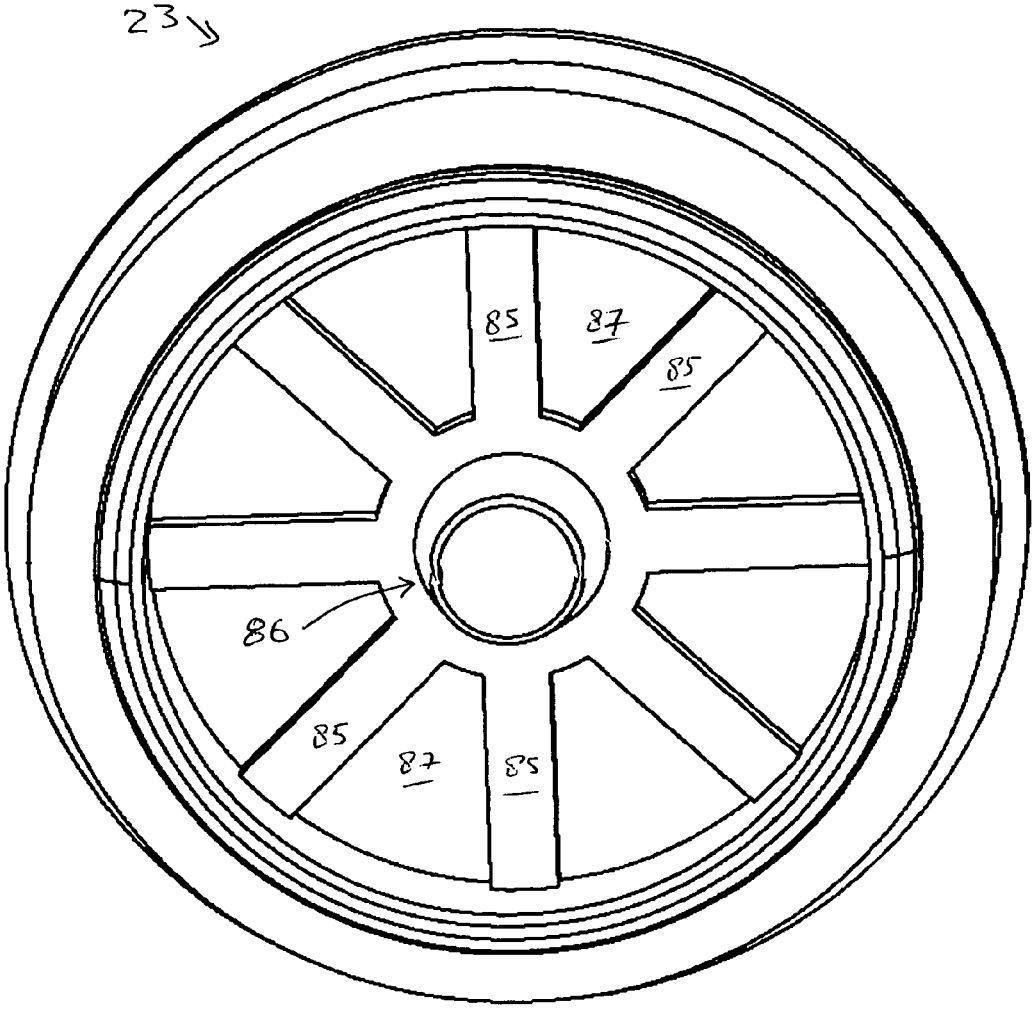
FIG. 17 is a perspective bottom view of the seat member shown in FIG. 16.

The seal member 24 is a resilient member preferably formed from an elastomeric material and inherently biased to assume its shape as seen in FIGS. 14, 15 and 18. The seal member 24 has an annular outer rim 88 from which an annular central diaphragm 89 extends radially inwardly to an annular inner rim 90 about a central opening 91. The annular outer rim 88 and inner rim 90 are coaxial about an axis 92. The seal member 24 is secured to the seat member 23 by the outer rim 88 of the seal member 24 engaging about the outer end 84 of the annular side wall 81 of the seat member 23 with a radially inwardly extending shoulder 93 of the seal member 24 engaged in the groove 82. The inner annular rim 90 interacts with the valve stem 86 to provide varying restriction on flow through the central openings 91.

As seen in FIG. 18, the valve stem 86 has a generally frustoconical side wall 93 tapering forwardly to merge with a generally outwardly convex, rounded distal end 94.

Figure 19:
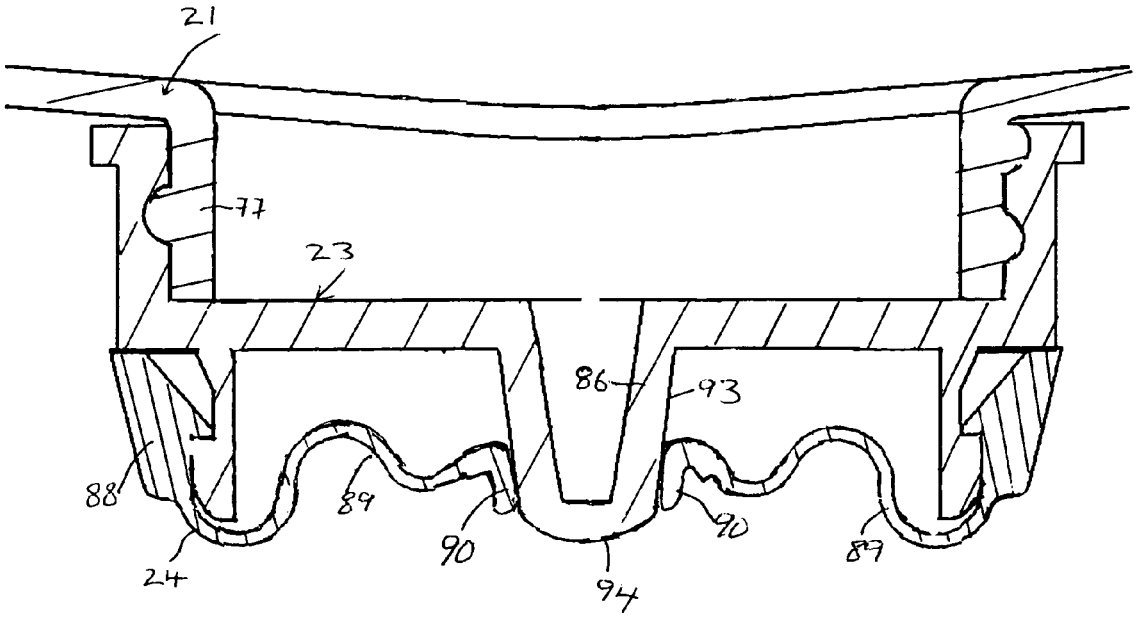
FIG. 19 is a cross-sectional side view of the neck of the bottle, the seat member and the seal member of FIG. 18 assembled and in a sealed condition.

FIG. 19 shows in side view the seat member 24 secured to the bottle 20 and the seal member 23 secured to the seat member 24 with the seal member 23 in a sealed condition. As shown, the inner rim 90 has been forced upwardly onto the frustoconical side wall 93 of the valve stem 86, thus stretching the circumference of the inner rim 90 so as to form a fluid impermeable seal upon the valve stem 86. This sealed condition is achieved by forcefully urging the inner rim 90 to stretch over the distal end 94 of the valve stem 86. The frictional engagement of the rim 90 onto the valve stem 86 determines the threshold vacuum, and can be varied by selection of the rim, stem and extent to which the rim is forced onto the stem.

Figure 20:
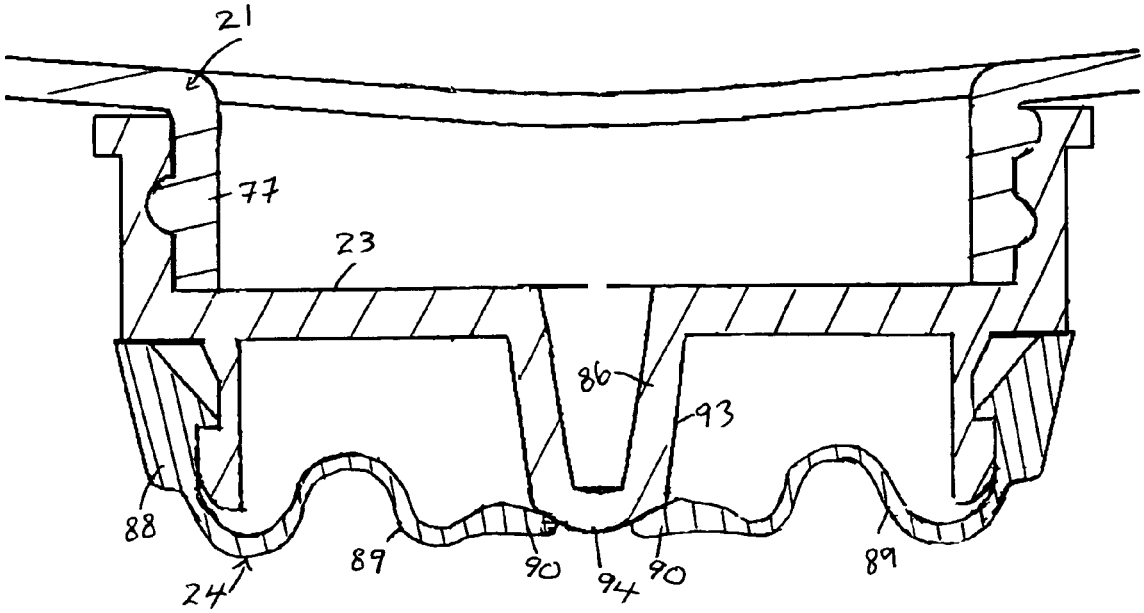
FIG. 20 is a cross-sectional side view similar to that in FIG. 19 but showing the seal member in the closed position of the openable condition.

FIG. 20 is a similar cross-section as that shown in FIG. 19, however, showing the inner rim 90 as engaging distal end 94 of the valve stem 86 in what is to be referred to as a closed position. The inner rim 90 engages the distal end 94 of the valve stem 86 in the closed position as shown in FIG. 18 due to the inherent bias of the seat member 24 and its resilient diaphragm 89. In this closed position, fluid flow is permitted outwardly past the seat member 24 when a pressure differential exists across the diaphragm 89 with lesser pressure on the outside of the diaphragm than on the inside of the bottle 21, then the diaphragm 89 will deflect to unseat the inner rim 90 from engagement with the distal end 86 to assume an open position as shown in FIG. 20. In the open position of FIG. 21, fluid flow is permitted outwardly past the seal member 24 through its opening 91. The bias of the inner rim 90 into the valve stem 86 determines the opening vacuum.

Figure 21:
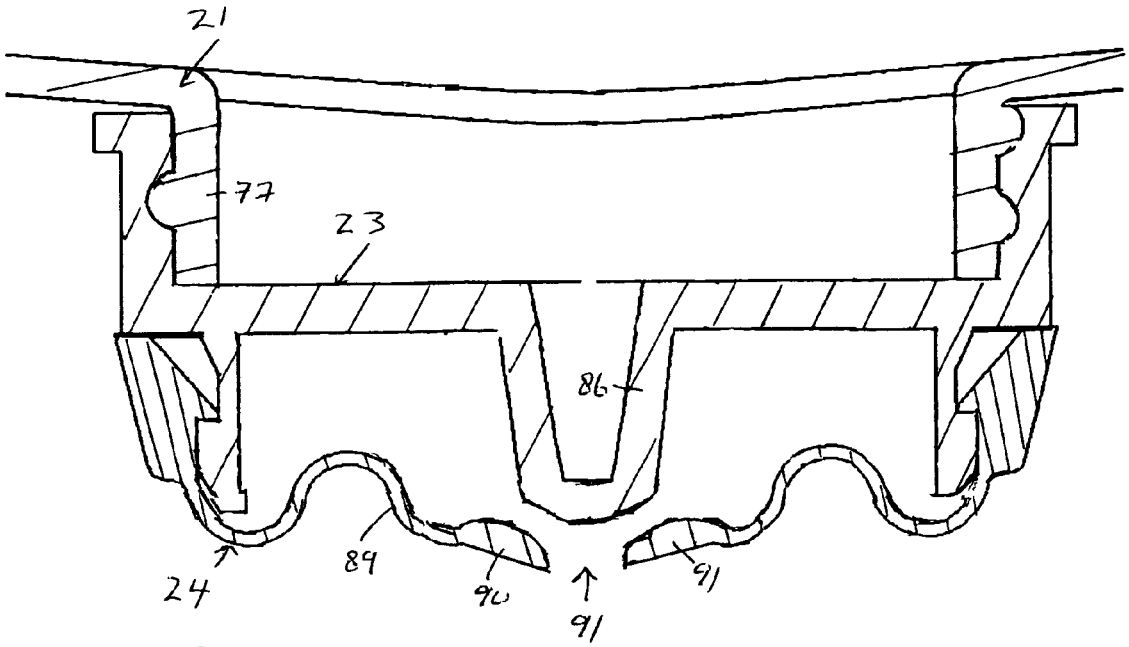
FIG. 21 is a cross-sectional side view which is the same as in FIG. 20, however, showing the seal member in the open position of the openable condition.

FIGS. 20 and 21 show the closed position and open position between which the seal member may move when the seal member is in what is referred to as the openable condition of the seal member 24, that is, a condition in which the seal member will, due to its inherent bias, assume the closed position of FIG. 20 or, if there is sufficient pressure differential thereacross, move to the open position of FIG. 21.

To move from the sealed condition of FIG. 19 to the openable condition of FIGS. 20 and 21 requires what is referred to as a threshold pressure differential across the diaphragm 89. To move from the closed position of FIG. 20 to the open position of FIG. 21 requires what is referred to as an opening pressure differential across the diaphragm 89. The threshold pressure differential is selected to be greater than the opening pressure differential.

Reference is made to FIG. 22 which shows a schematic cross-sectional view of the pump mechanism 13 with both reservoir units 20 coupled thereto. As seen, the neck 77, seat member 23 and seal member 24 of each reservoir unit 20 are coaxially received in the reservoir junction tubes 70 and 71 with a resilient outer periphery of the outer annular rim 88 of each seal member 24 biased inwardly to provide a fluid impermeable seal between each reservoir unit 20 and the reservoir junction tube 70 or 71.

Operation of the dispenser is now described. Preferably, both reservoir units 20 are initially engaged on the pump mechanism 13 with each reservoir unit 20 having its seal member 24 in the sealed condition. Reciprocal movement of the piston 14 draws fluid from the main chamber 40 and dispenses fluid from the outlet 51 of the piston 14. A vacuum, that is, pressure below atmospheric pressure, is created in the main chamber 40 and in each reservoir junction tube 70 and 71 on the outlet side of the diaphragm 89 of the seal member 24. The vacuum increases in the main chamber 40 by pumping of the piston 14 until a threshold vacuum is reached at which a first of the diaphragm 89 under the pressure differential across it moves from the sealed condition to the openable condition. Due to the vacuum in the main chamber 40, the diaphragm 89 assumes the open position and fluid is dispensed from that first reservoir unit 20 until the vacuum in the main chamber 40 may with dispensing of fluid lessen to be less than the opening vacuum for that seal member 24 and the diaphragm 89 will move to the closed position. With subsequent operation of the piston 14, vacuum is created in the chamber 40 which, when the opening vacuum is exceeded, will overcome the bias of the diaphragm 89 of the seal member 24 and move the seal member 24 to the open position with fluid to dispense lessening the vacuum until the diaphragm again moves to the closed position. With continued operation of the piston 14, fluid is emptied from the first bottle 21 with the first bottle 21 collapsing. When all of the fluid in the first bottle 21 has been dispensed, with further pumping of the piston 14, the vacuum in the chamber 40 will increase until a threshold vacuum at which the diaphragm 89 of the second bottle 21 moves from the sealed condition to the openable condition and in the openable condition, fluid is then dispensed from that second reservoir unit 20 with subsequent operation of the pump mechanism. In this regard, when the pump mechanism is not activated, the vacuum in the main chamber 40 will lessen to be less than the opening vacuum level for the diaphragm 89 of the second bottle. With subsequent operation of the piston 14, vacuum is again created in the main chamber 40 which, when the opening vacuum level is exceeded, overcomes the bias of the diaphragm 89 and the seal member of the second bottle moves temporarily to the open position. With repeated operation of the piston 14, fluid is emptied from the second bottle 21 with the second bottle collapsing.

For proper operation of the invention, the threshold vacuum for the first reservoir unit is a greater vacuum below atmospheric than the threshold vacuum for the second reservoir unit. The threshold vacuum for each of the two reservoir units is a greater vacuum than the opening vacuum for either reservoir units. As well, the threshold vacuum for each of the two units is a greater vacuum than the collapsing vacuum of each of the two units. The collapsing vacuum is referred to as that vacuum required in the chamber 40 to reasonably collapse a bottle and withdraw, preferably, substantially all fluid from the bottle.

The collapsing vacuum may be considered largely a property of each bottle 21. The vacuum at the outlet 22 of each bottle 21 which will draw fluid from similar bottles 21 will typically vary depending on the extent to which a bottle is filled with fluid and, typically, will increase as the bottle 21 becomes increasingly emptied of fluid and collapsed. Typically, the vacuum to draw additional fluid from the bottle 21 will be greatest immediately before substantially all fluid which is reasonably capable of being drawn out has been drawn out.

The vacuum in the chamber 40 required to substantially collapse a bottle 21 typically will be significantly determined by the construction of the bottle, however, will also be influenced by the nature and viscosity of the fluid to be dispensed as well as the resistance to flow from the bottle 21 to the chamber 40.

When a bottle is to be considered adequately collapsed, with adequate fluid withdrawn for a bottle to be replaced, may vary considerably, with factors such as the cost of the bottle, the cost of the fluid and the costs of pump mechanisms to achieve higher vacuums. Similarly, the collapsing vacuum may vary considerably. Nevertheless, in any dispenser having regard to the collapsing vacuum for the bottles, the threshold vacuum for every reservoir unit 20 should preferably be selected to be greater than the collapsing vacuum for every reservoir. Preferably, the opening vacuum will be less than the collapsing vacuum, although this is not necessary.

Preferably in operation, after the first reservoir unit 20 has been collapsed and emptied, whether the second reservoir is full or partially full, the first reservoir unit 20 is manually removed from engagement in the reservoir junction tube 70 or 71. A new third replacement reservoir unit 20 may be inserted full of liquid and in a sealed condition. As is to be appreciated, after the second reservoir unit 20 may be emptied, the vacuum will then increase in the main chamber 40 to move the seal member 24 on the third replacement reservoir unit 20 from the sealed condition to the openable condition for dispensing. Subsequently, the second reservoir unit 20 may be replaced by yet another further fourth replacement unit. With further dispensing, replacement of an emptied reservoir unit by a replacement reservoir unit may be successively continued. In this manner, each emptied reservoir unit 20 may be replaced only after it has been fully emptied and preferably before the other reservoir unit has been emptied. Thus, reservoir units which are discarded are substantially emptied of all fluid yet the dispenser 10 will always have fluid in one of its two reservoir units 20 for dispensing. It is to be appreciated that by reasonable periodic checking of the dispenser 10 that the dispenser may become to be inspected after emptying of one reservoir unit 20 and before emptying of both reservoir units 20. The reservoir units 20 may preferably be shipped and stored in the sealed condition which assists in avoiding contamination.

The preferred embodiment shows the seat member 23 and seal member 24 forming a primary one-way valve for each bottle 21 and being carried on the bottle 21. This is preferred especially where the bottle 21 is to be coupled to a dispenser inverted as shown. However, the one-way valve for each bottle 21 could be provided as part of the pump mechanism 13, for example, by the seat member 23 and its seal member being held engaged in the reservoir junction tubes 70 and 71 adjacent removal, and with removable sealed coupling of the bottle 21 to the seat member 23 as via the threads 138.

The preferred embodiment shows secondary one-way valves 17 and 18 between the main chamber 40 on each reservoir junction tube 70 and 71. These secondary one-way valves 17 and 18 are advantageous such that when changing one reservoir unit 20 fluid which may be in the main chamber 40 will not become discharged into the reservoir junction tube 70 or 71 from which the reservoir unit 20 has been removed, however, such secondary one-way valves 17 and 18 are not necessary and may be eliminated particularly when in a configuration as shown, the reservoir units 20 are disposed above the main chamber 40.

The preferred embodiment shows the main chamber 40 adapted to have two reservoir units 20 coupled to it. However, the main chamber 40 may be adapted to couple to three or more reservoir units.

In the preferred embodiment, the pump mechanism 13 is shown with the piston chamber 46 at a height below the main chamber 40 and with the main chamber 40 at a height below the reservoir units 20. This is not necessary. Since fluid is drawn out under vacuum conditions, the relative height of any of the piston chamber 46, main chamber 40, reservoir junction tubes 70 and 71 and the bottles 21 may vary provided that they are connected for flow from each bottle 21 to the chamber 40 to the piston chamber 46. The bottles 21 may be inverted with their outlets 22 to be at the top. The pump outlet 51 may be directed upwardly or downwardly or sideways or otherwise.

Preferably, the pump mechanism 13 will be capable of withdrawing and dispensing air so as to create necessary vacuum conditions whenever air may be in the pump chamber 46, the main chamber 40, the reservoir junction tubes 70 and 71 or the reservoir units including the bottles 21 as may occur in their different circumstance of operation, initial activation and changing of reservoir units 20.

The preferred embodiment show the use of a pump with a reciprocal piston 14 for dispensing. This is not necessary and any manner of a pump mechanism may be used in replacement of the piston pump shown, whether manual or automatic, which can create the required vacuum.

Figure 23:
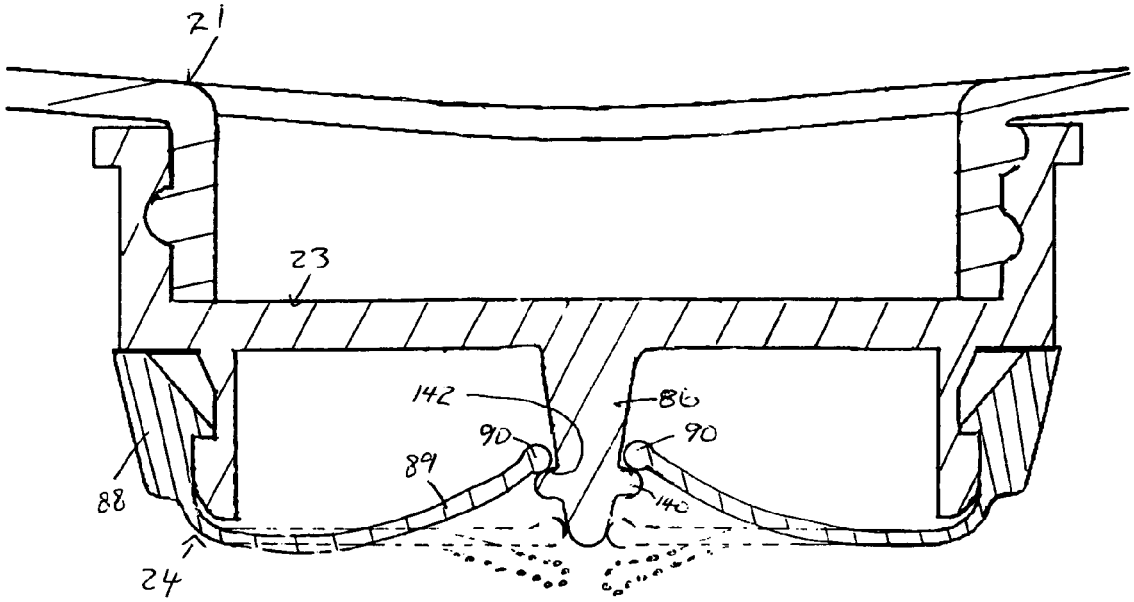
FIG. 23 is a view similar to FIG. 21 but of another second embodiment of a valve stem.

Reference is made to FIG. 23 which shows an alternate embodiment for a configuration of the valve stem 86 of the seat element 23 best shown in FIGS. 18 to 21. In the embodiment of FIG. 23, which is a side view similar to that shown in the dashed circle in FIG. 21, the valve stem 86 is also a frustoconical member with a rounded distal end. The frustoconical portion 86 includes an outwardly extending annular flange 140 which provides an inwardly directed shoulder 142 behind which the annular rim 90 of the seal member 24 is positioned to hold the annular rim 90 in the sealed condition shown in solid lines being a condition which requires greater vacuum forces for removal. The dashed lines show the diaphragm portion 89 and the inner rim 90 of the seal member 24 in the openable condition, closed position as sealing by the rim 90 engaging the frustoconical portion in the closed position. The dashed lines show the seal member in the open position.

Figure 24:
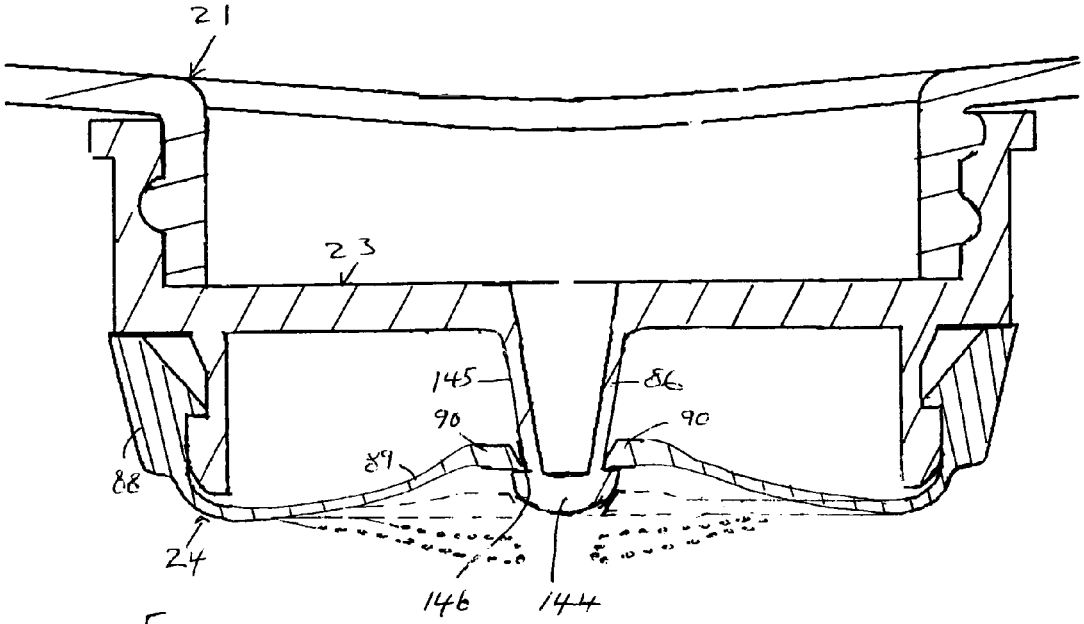
FIG. 24 is a view similar to FIG. 23 but of a third embodiment of a valve stem.

FIG. 24 is a view of another embodiment similar to FIG. 23 in which the valve stem 86 has an enlarged head 144 with a generally curved distal end and is provided to have a portion 145 be of reduced diameter rearward from the head 144 to provide a rearwardly directed shoulder 146. Solid lines indicate the position of the diaphragm 89 of the seal member 24 and its inner rim 90 in the sealed condition. The annular rim 90 is forced to assume the sealed condition with the annular rim 90 is forced to snap-fit into the reduced diameter portion 145 behind the shoulder 146, however, remains in sealed engagement about the reduced diameter portion 145. From the sealed condition, the diaphragm 89 may be deflected forwardly to move to the closed position shown in dashed lines and the open position in dotted lines.

Figure 25:
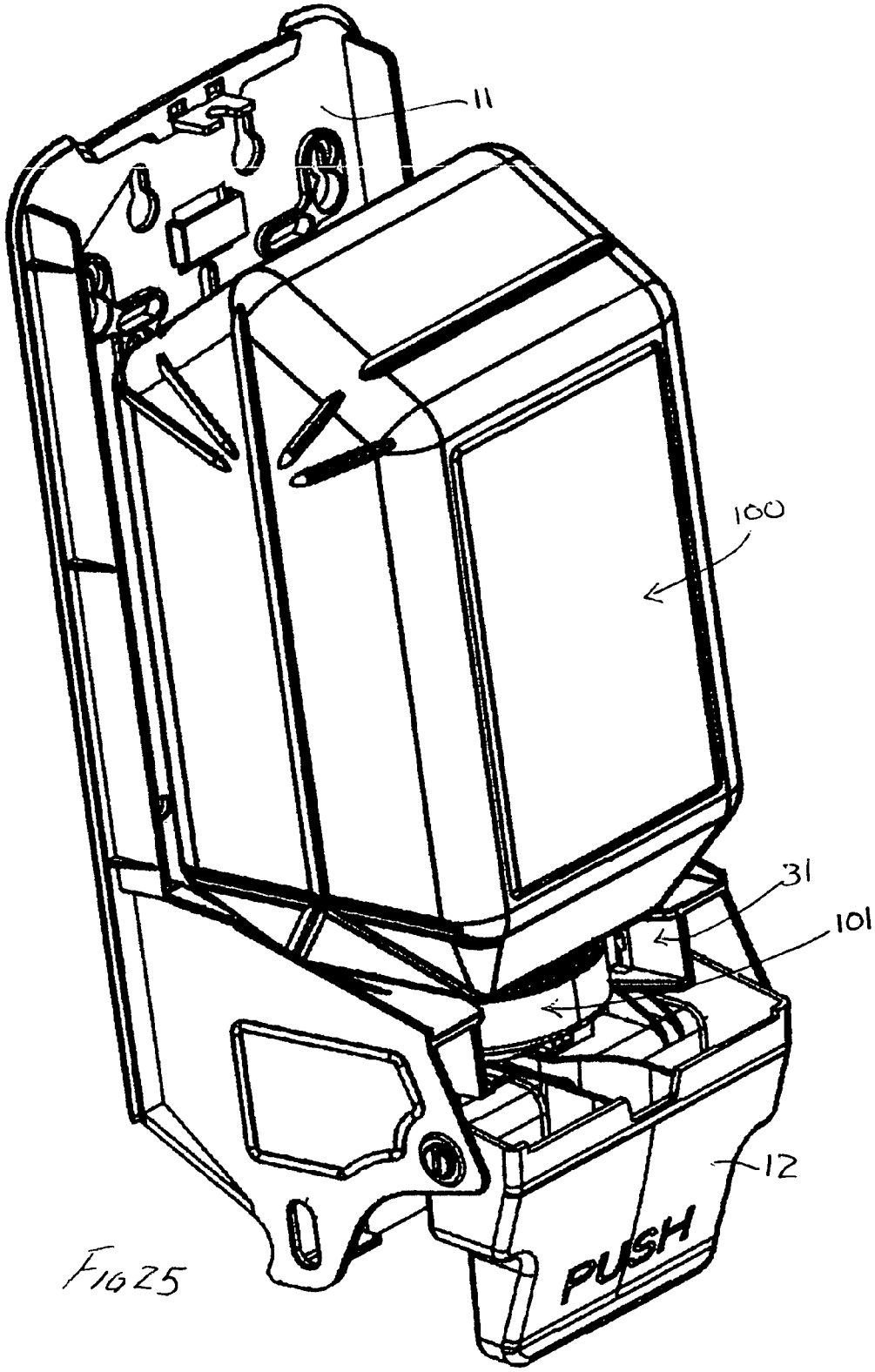
FIG. 25 is a perspective view of a single reservoir dispenser utilizing the same housing member and lever as in FIG. 1.
Figure 26:
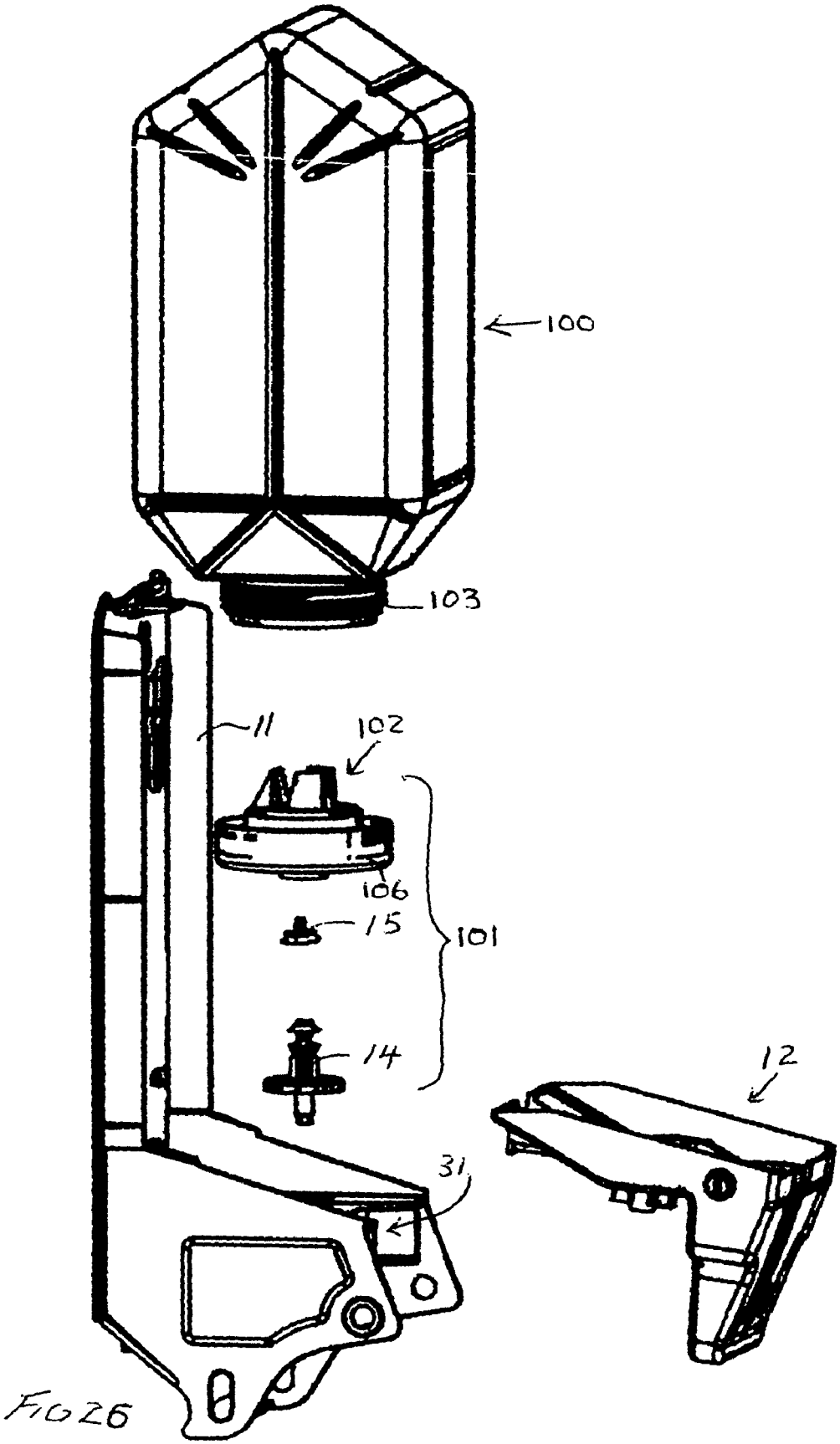
FIG. 26 is an exploded perspective view of the dispenser of FIG. 23.

Reference is made to FIGS. 24 and 25 which illustrate the use of the same housing member 11 and lever member 12 as in FIGS. 1, 2 and 3 but with a single bottle 100. The bottle 100 has a pump mechanism 101 including a piston chamber forming element 102 which is threadably secured to the neck 103 of the bottle 100 and provides an internal pump chamber to receive both a one-way piston cup valve 15 and a piston 14 the same as in FIGS. 1 to 3. The element 102 has a cylindrical outer flange 106 sized to be snap-fit inside the channelway 31 of the housing member 11 to similarly support the pump mechanism 101 on housing member 11. The housing member 11 and the lever member 12 are thus adapted for use either with a single bottle as in FIGS. 24 and 25 or with twin reservoir units as in FIGS. 1 to 3.

While the invention has been defined with reference to preferred embodiments, many variations and modifications will now occur to persons skilled in the art. For a definition of the invention, reference is made to the following claims.

I claim:

1. A dispenser for dispensing fluids comprising:

a pump mechanism operative for pumping fluid from a chamber out of an outlet thereby creating vacuum conditions below atmospheric in the chamber, at least two collapsible fluid containing reservoirs enclosed but for each having an outlet passageway in communication with the chamber, a primary one-way valve for each reservoir permitting flow of fluid from each reservoir through the passageway to the chamber when certain vacuum conditions exist in the chamber relative the reservoir, each one-way valve being in an initial sealed condition preventing flow from its respective reservoir until a threshold vacuum for that valve is exceeded in the chamber by operation of the pump mechanism, the threshold vacuum for each valve being different than the threshold vacuum of all the other valves, wherein after the threshold vacuum of one of the valves is exceeded by operation of the pump mechanism, that valve permitting flow of fluid from its reservoir by further operation of the pump mechanism to create vacuum conditions less than the threshold value of that valve and the other valves until its reservoir is substantially emptied whereafter further operation of the pump mechanism creates a vacuum in the chamber which exceeds the threshold vacuum for another of the valves after which such other of the valves permitting flow of fluid from its reservoir by operation of the pump mechanism.

2. A dispenser as claimed in claim 1 wherein each valve assuming either a sealed condition or an openable condition, in the sealed condition, each valve prevents flow of fluid from its respective reservoir through its passageway to the chamber and is biased to remain in the sealed condition against moving to the openable condition unless the valve is subjected on its chamber side to a vacuum below atmospheric greater than the threshold vacuum for the valve whereupon the valve moves from the sealed condition to the openable condition, in the openable condition:

(a) each valve is movable between a closed position and an open position, (b) each valve is biased to return to and remain in the closed position and against moving from the closed position toward the open position other than when subjected to a vacuum below atmospheric greater than an opening vacuum of the valve when the valve moves from the closed position toward the open position permitting flow of fluid from its respective reservoir through its passageway to the chamber, (c) in the closed position, each valve prevents flow of fluid from its respective reservoir through its passageway to the chamber, and (d) in the open position, each valve permits flow of fluid from its respective reservoir through its passageway to the chamber, the threshold vacuum of each valve being a greater vacuum below atmosphere than its opening vacuum and the opening vacuum of all other valves.

3. A dispenser as claimed in claim 2 wherein when one valve is in the openable condition, a collapsing vacuum for that valve is a vacuum required in the chamber to substantially collapse the reservoir of that valve, the threshold vacuum of each valve being a greater vacuum below atmosphere than the collapsing vacuum of all valves.

4. A pump as claimed in claim 2 wherein each of the reservoirs is removably coupled to the chamber for independent disengagement and removal and replacement with a substitute reservoir containing fluid to be dispensed.

5. A pump as claimed in claim 3 wherein each of the reservoirs and its respective one-way valve is an independent reservoir unit removably coupled to the chamber for disengagement and removal and replacement with a similar replacement reservoir unit independently of the other reservoir units.

6. A pump as claimed in claim 4 wherein each replacement reservoir unit contains fluid to be dispensed and has its valve in the sealed condition.

7. A dispenser as claimed in claim 1 wherein said reservoirs comprise a first reservoir and a second reservoir, said one-way valves comprising a first one-way valve for the first reservoir and a second one-way valve for the second reservoir, the first valve assuming either a sealed condition or an openable condition, in the sealed condition, the first valve prevents flow of fluid from the first reservoir through its passageway to the chamber and is biased to remain in the sealed condition against moving to the openable condition unless the first valve is subjected on a chamber side of the first valve to a vacuum below atmospheric greater than the threshold vacuum for the first valve whereupon the first valve moves from the sealed condition to the openable condition, in the openable condition, the first valve is movable between a closed position and an open position, in the closed position, the first valve prevents flow of fluid from the first reservoir through its passageway to the chamber and is biased to return to and remain in the closed position and against moving from the closed position toward the open position other than when the first valve is subjected on the chamber side of the first valve to a vacuum below atmospheric greater than an opening vacuum of the first valve when the first valve moves from the closed position toward the open position permitting flow of fluid from the first reservoir through its passageway to the chamber, the second valve assuming either a sealed condition or an openable condition, in the sealed condition, the second valve prevents flow of fluid from the second reservoir through its passageway to the chamber and is biased to remain in the sealed condition against moving to the openable condition unless the second valve is subjected on a chamber side of the second valve to a vacuum below atmospheric greater than the threshold vacuum for the second valve whereupon the second valve moves from the sealed condition to the openable condition, in the openable condition, the second valve is movable between a closed position and an open position, in the closed position, the second valve prevents flow of fluid from the second reservoir through its passageway to the chamber and is biased to return to and remain in the closed position and against moving from the closed position toward the open position other than when the second valve is subjected on the chamber side of the second valve to a vacuum below atmospheric greater than an opening vacuum of the second valve when the second valve moves from the closed position toward the open position permitting fluid flow from the second reservoir through its passageway to the chamber, the threshold vacuum of the first valve being a greater vacuum below atmosphere than the opening vacuum of the first valve and the opening vacuum of the second valve, the threshold vacuum of the second valve being a greater vacuum below atmosphere than the opening vacuum of the first valve and the opening vacuum of the second valve, the threshold vacuum of the first valve being a greater vacuum below atmosphere the threshold vacuum of the second valve.

8. A dispenser as claimed in claim 6 wherein said reservoirs comprise a third reservoir, said one-way valves comprising a third one-way valve for the third reservoir, the third valve assuming either a sealed condition or an openable condition, in the sealed condition, the third valve prevents flow of fluid from the third reservoir through its passageway to the chamber and is biased to remain in the sealed condition against moving to the openable condition unless the third valve is subjected on a chamber side of the third valve to a vacuum below atmospheric greater than the threshold vacuum for the third valve whereupon the third valve moves from the sealed condition to the openable condition, in the openable condition, the third valve is movable between a closed position and an open position, in the closed position, the third valve prevents flow of fluid from the third reservoir through its passageway to the chamber and is biased to return to and remain in the closed position and against moving from the closed position toward the open position other than when the third valve is subjected on the chamber side of the third valve to a vacuum below atmospheric greater than an opening vacuum of the third valve when the third valve moves from the closed position toward the open position permitting flow of fluid from the third reservoir through its passageway to the chamber, the threshold vacuum of the second valve being a greater vacuum below atmosphere the threshold vacuum of the third valve, the threshold vacuum of the third valve being a greater vacuum below atmosphere than the opening vacuum of the first valve, the opening vacuum of the second valve and the opening vacuum of the third valve, the threshold vacuum of the first valve being a greater vacuum below atmosphere than the opening vacuum of the third valve, the threshold vacuum of the second valve being a greater vacuum below atmosphere than the opening vacuum of the third valve.

9. A dispenser as claimed in claim 1 including a secondary one-way valve for each reservoir disposed in the outlet passageway between the primary one-way valve and the chamber and permitting flow of fluid from the primary one-way valve to the chamber whenever vacuum conditions exist in the chamber which would permit fluid flow through the primary one-way valve.

10. A method of use of a dispenser as claimed in claim 3 wherein after one of the reservoirs is emptied of fluid and before all other reservoirs are emptied that one reservoir is replaced by the substitute reservoir.

11. A dispenser for dispensing fluids comprising:

a pump mechanism operative for pumping fluid from a chamber out of an outlet thereby creating vacuum conditions below atmospheric in the chamber, at least two collapsible fluid containing reservoirs enclosed but for each having an outlet passageway in communication with the chamber, a primary one-way valve for each reservoir permitting flow of fluid from each reservoir through the passageway to the chamber when certain vacuum conditions exist in the chamber relative the reservoir, each valve having a threshold vacuum defined as a vacuum in the chamber below a pressure in the respective reservoir for each valve, each valve assuming either a sealed condition or an openable condition, each valve movable from the a sealed condition to the openable condition when the vacuum in the chamber exceeds the threshold vacuum for that valve, each one-way valve in the sealed condition preventing flow from its respective reservoir, each one-way valve in the openable condition permitting flow from its respective reservoir when the certain vacuum conditions exist in the chamber relative the reservoir, the threshold vacuum for each valve being different than the threshold vacuum of all the other valves, wherein with all the valves in the sealed condition, after the threshold vacuum of one of the valves is exceeded by operation of the pump mechanism, that one valve moving to the openable condition permitting flow of fluid from its reservoir by further operation of the pump mechanism to create vacuum conditions in the chamber less than the threshold value of that one valve and the other valves until the reservoir of that one valve is substantially emptied whereafter further operation of the pump mechanism creates a vacuum in the chamber which exceeds the threshold vacuum for a second of the valves where upon that second valve moving to the openable condition after which such second valve permitting flow of fluid from its reservoir by further operation of the pump mechanism.

12. A dispenser as claimed in claim 11 wherein in the sealed condition, each valve prevents flow of fluid from its respective reservoir through its passageway to the chamber and is biased to remain in the sealed condition against moving to the openable condition unless the valve is subjected on its chamber side to a vacuum below atmospheric greater than the threshold vacuum for the valve whereupon the valve moves from the sealed condition to the openable condition, in the openable condition:

(a) each valve is movable between a closed position and an open position, (b) each valve is biased to return to and remain in the closed position and against moving from the closed position toward the open position other than when subjected to a vacuum below atmospheric greater than an opening vacuum of the valve when the valve moves from the closed position toward the open position permitting flow of fluid from its respective reservoir through its passageway to the chamber, (c) in the closed position, each valve prevents flow of fluid from its respective reservoir through its passageway to the chamber, and (d) in the open position, each valve permits flow of fluid from its respective reservoir through its passageway to the chamber, the threshold vacuum of each valve being a greater vacuum below atmosphere than its opening vacuum and the opening vacuum of all other valves.

13. A dispenser as claimed in claim 12 wherein when one valve is in the openable condition, a collapsing vacuum for that valve is a vacuum required in the chamber to substantially collapse the reservoir of that valve, the threshold vacuum of each valve being a greater vacuum below atmosphere than the collapsing vacuum of all valves.

14. A pump as claimed in claim 12 wherein each of the reservoirs is removably coupled to the chamber for independent disengagement and removal and replacement with a substitute reservoir containing fluid to be dispensed.

15. A pump as claimed in claim 13 wherein each of the reservoirs and its respective one-way valve is an independent reservoir unit removably coupled to the chamber for disengagement and removal and replacement with a similar replacement reservoir unit independently of the other reservoir units.

16. A pump as claimed in claim 14 wherein each replacement reservoir unit contains fluid to be dispensed and has its valve in the sealed condition.

17. A dispenser as claimed in claim 11 wherein said reservoirs comprise a first reservoir and a second reservoir, said one-way valves comprising a first one-way valve for the first reservoir and a second one-way valve for the second reservoir, in the sealed condition, the first valve prevents flow of fluid from the first reservoir through its passageway to the chamber and is biased to remain in the sealed condition against moving to the openable condition unless the first valve is subjected on a chamber side of the first valve to a vacuum below atmospheric greater than the threshold vacuum for the first valve whereupon the first valve moves from the sealed condition to the openable condition, in the openable condition, the first valve is movable between a closed position and an open position, in the closed position, the first valve prevents flow of fluid from the first reservoir through its passageway to the chamber and is biased to return to and remain in the closed position and against moving from the closed position toward the open position other than when the first valve is subjected on the chamber side of the first valve to a vacuum below atmospheric greater than an opening vacuum of the first valve when the first valve moves from the closed position toward the open position permitting flow of fluid from the first reservoir through its passageway to the chamber, in the sealed condition, the second valve prevents flow of fluid from the second reservoir through its passageway to the chamber and is biased to remain in the sealed condition against moving to the openable condition unless the second valve is subjected on a chamber side of the second valve to a vacuum below atmospheric greater than the threshold vacuum for the second valve whereupon the second valve moves from the sealed condition to the openable condition, in the openable condition, the second valve is movable between a closed position and an open position, in the closed position, the second valve prevents flow of fluid from the second reservoir through its passageway to the chamber and is biased to return to and remain in the closed position and against moving from the closed position toward the open position other than when the second valve is subjected on the chamber side of the second valve to a vacuum below atmospheric greater than an opening vacuum of the second valve when the second valve moves from the closed position toward the open position permitting fluid flow from the second reservoir through its passageway to the chamber, the threshold vacuum of the first valve being a greater vacuum below atmosphere than the opening vacuum of the first valve and the opening vacuum of the second valve, the threshold vacuum of the second valve being a greater vacuum below atmosphere than the opening vacuum of the first valve and the opening vacuum of the second valve, the threshold vacuum of the first valve being a greater vacuum below atmosphere the threshold vacuum of the second valve.

18. A dispenser as claimed in claim 16 wherein said reservoirs comprise a third reservoir, said one-way valves comprising a third one-way valve for the third reservoir, in the sealed condition, the third valve prevents flow of fluid from the third reservoir through its passageway to the chamber and is biased to remain in the sealed condition against moving to the openable condition unless the third valve is subjected on a chamber side of the third valve to a vacuum below atmospheric greater than the threshold vacuum for the third valve whereupon the third valve moves from the sealed condition to the openable condition, in the openable condition, the third valve is movable between a closed position and an open position, in the closed position, the third valve prevents flow of fluid from the third reservoir through its passageway to the chamber and is biased to return to and remain in the closed position and against moving from the closed position toward the open position other than when the third valve is subjected on the chamber side of the third valve to a vacuum below atmospheric greater than an opening vacuum of the third valve when the third valve moves from the closed position toward the open position permitting flow of fluid from the third reservoir through its passageway to the chamber, the threshold vacuum of the second valve being a greater vacuum below atmosphere the threshold vacuum of the third valve, the threshold vacuum of the third valve being a greater vacuum below atmosphere than the opening vacuum of the first valve, the opening vacuum of the second valve and the opening vacuum of the third valve, the threshold vacuum of the first valve being a greater vacuum below atmosphere than the opening vacuum of the third valve, the threshold vacuum of the second valve being a greater vacuum below atmosphere than the opening vacuum of the third valve.

19. A dispenser as claimed in claim 11 including a secondary one-way valve for each reservoir disposed in the outlet passageway between the primary one-way valve and the chamber and permitting flow of fluid from the primary one-way valve to the chamber whenever vacuum conditions exist in the chamber which would permit fluid flow through the primary one-way valve.

20. A method of use of a dispenser as claimed in claim 13 wherein after one of the reservoirs is emptied of fluid and before all other reservoirs are emptied that one reservoir is replaced by the substitute reservoir.

* * * * *

UNITED STATES PATENT AND TRADEMARK OFFICE

CERTIFICATE OF CORRECTION

PATENT NO. : 7,735,686 B2
APPLICATION NO. : 11/636945
DATED : June 15, 2010
INVENTOR(S) : Heiner Ophardt It is certified that error appears in the above-identified patent and that said Letters Patent is hereby corrected as shown below:

IN THE CLAIMS:
Column 12, In Claim 4, line 1, replace “pump” by --dispenser--;
Column 12, In Claim 5, line 1, replace “pump” by --dispenser--;
Column 12, In Claim 6, line 1, replace “pump” by --dispenser--;
Column 15, In Claim 14, line 1, replace “pump” by --dispenser--;
Column 15, In Claim 15, line 1, replace “pump” by --dispenser--;
Column 15, In Claim 16, line 1, replace “pump” by --dispenser--.

Signed and Sealed this
Twenty-sixth Day of February, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 7,735,686 B2
APPLICATION NO. : 11/636945
DATED : June 15, 2010
INVENTOR(S) : Heiner Ophardt It is certified that error appears in the above-identified patent and that said Letters Patent is hereby corrected as shown below:

IN THE CLAIMS:
Column 12, line 36 (Claim 4, line 1) replace “pump” by --dispenser--;
Column 12, line 40 (Claim 5, line 1) replace “pump” by --dispenser--;
Column 12, line 46 (Claim 6, line 1) replace “pump” by --dispenser--;
Column 15, line 43 (Claim 14, line 1) replace “pump” by --dispenser--;
Column 15, line 47 (Claim 15, line 1) replace “pump” by --dispenser--;
Column 15, line 53 (Claim 16, line 1) replace “pump” by --dispenser--.

This certificate supersedes the Certificate of Correction issued February 26, 2013.

Signed and Sealed this
Nineteenth Day of March, 2013

Teresa Stanek Rea
*Acting Director of the United States Patent and Trademark Office*